US007488247B2

(12) United States Patent
Hughs-Baird et al.

(10) Patent No.: US 7,488,247 B2
(45) **Date of Patent: *Feb. 10, 2009**

(54) GAMING DEVICE HAVING AN INTERACTIVE SEQUENCE GAME WITH A MULTIPLE FUNCTION MULTIPLIER

(75) Inventors: Andrea C. Hughs-Baird, Reno, NV (US); Joseph E. Kaminkow, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/952,704

(22) Filed: Dec. 7, 2007

(65) Prior Publication Data

US 2008/0090646 A1 Apr. 17, 2008

Related U.S. Application Data

(62) Division of application No. 10/327,276, filed on Dec. 20, 2002, now Pat. No. 7,306,518.

(51) Int. Cl.
*A63F 9/24* (2006.01)

(52) U.S. Cl. ..... 463/20

(58) Field of Classification Search ..... 463/16–20, 463/25

See application file for complete search history.

(56) References Cited

U.S. PATENT DOCUMENTS

| | | | |
|---|---|---|---|
| 4,305,131 | A | 12/1981 | Best |
| 5,094,458 | A | 3/1992 | Kamille |
| 5,456,465 | A | 10/1995 | Durham |
| 5,732,948 | A | 3/1998 | Yoseloff |
| 5,769,716 | A | 6/1998 | Saffari et al. |
| 5,788,573 | A | 8/1998 | Baerlocher et al. |
| 5,823,874 | A | 10/1998 | Adams |

(Continued)

FOREIGN PATENT DOCUMENTS

| | | |
|---|---|---|
| AU | 199716432 | 9/1997 |

(Continued)

OTHER PUBLICATIONS

Wheel of Fortune for Nintendo game manual Sep. 11, 1988.*

(Continued)

*Primary Examiner*—Robert E Pezzuto
*Assistant Examiner*—Jasson H Yoo
(74) *Attorney, Agent, or Firm*—Bell, Boyd & Lloyd LLP

(57) ABSTRACT

A gaming device having a game which displays an award distributor and a sequence of groups to a player. A processor causes the award distributor to indicate an award. Furthermore, the gaming device enables the player to pick one of the groups in the sequence. The processor reveals at least one element associated with the picked group in the sequence. A multiplier provided to the player changes based on the number of elements revealed in the sequence. The processor provides an activation award to the player, which equals the indicated award multiplied by the multiplier. The player continues to play the game until all of the groups are picked in the sequence. In another embodiment, at least one risk symbol is associated with the award distributor wherein the risk symbols modify one or more game components in the game.

37 Claims, 23 Drawing Sheets

U.S. PATENT DOCUMENTS

| | | | |
|---|---|---|---|
| 5,833,537 | A | 11/1998 | Barrie |
| 5,848,932 | A | 12/1998 | Adams |
| 5,919,088 | A | 7/1999 | Weiss |
| 6,004,207 | A | 12/1999 | Wilson, Jr. et al. |
| 6,059,289 | A | 5/2000 | Vancura |
| 6,089,978 | A | 7/2000 | Adams |
| 6,149,521 | A | 11/2000 | Sanduski |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,224,483 | B1 | 5/2001 | Mayeroff |
| 6,231,442 | B1 | 5/2001 | Mayeroff |
| 6,238,288 | B1 | 5/2001 | Walker et al. |
| 6,309,300 | B1 | 10/2001 | Glavich |
| 6,312,334 | B1 | 11/2001 | Yoseloff |
| 6,328,649 | B1 | 12/2001 | Randall et al. |
| 6,334,814 | B1 | 1/2002 | Adams |
| 6,340,158 | B2 | 1/2002 | Preice et al. |
| 6,346,043 | B1 | 2/2002 | Colin et al. |
| 6,347,996 | B1 | 2/2002 | Gilmore et al. |
| 6,364,766 | B1 | 4/2002 | Anderson et al. |
| 6,398,218 | B1 | 6/2002 | Vancura |
| 6,406,369 | B1 | 6/2002 | Baerlocher et al. |
| 6,416,408 | B2 | 7/2002 | Tracy et al. |
| 6,419,579 | B1 | 7/2002 | Bennett |
| 6,428,412 | B1 | 8/2002 | Anderson et al. |
| 6,454,651 | B1 | 9/2002 | Yoseloff |
| 6,471,208 | B2 | 10/2002 | Yoseloff et al. |
| 6,481,713 | B2 | 11/2002 | Perrie et al. |
| 6,561,904 | B2 | 5/2003 | Locke et al. |
| 6,569,015 | B1 | 5/2003 | Baerlocher et al. |
| 6,719,630 | B1 | 4/2004 | Seelig et al. |

FOREIGN PATENT DOCUMENTS

| | | | |
|---|---|---|---|
| AU | A-50327/96 | | 10/1997 |
| AU | A-63553/98 | | 10/1998 |
| EP | 0798676 | A1 | 10/1997 |
| EP | 0874337 | A1 | 10/1998 |
| EP | 0 926 645 | A2 | 6/1999 |
| EP | 0 944 030 | A2 | 9/1999 |
| GB | 2328311 | A | 2/1999 |
| WO | WO 00/12186 | | 3/2000 |

OTHER PUBLICATIONS

American Thunder Screen Shots written by IGT, published in 1998.
Bally Slot Machines Electro-Mechanicals 1964-1980 Book [In part], Revised 3rd Edition written by Marshall Fey.
Bonus Times Article written by Strictly Slots, published in 2000.
Cash Box Advertisement & Article written by Anchor Games, Strictly Slots, published in 2000.
Field Testing New Slots Article, written by Strictly Slots, published in Jul. 2000.
Good Times, written by International Gaming Technology, published in 1999.
Handhaeld Heaven printed from http:..www.retrogames.co.uk//stock/html/cd__games.html on Feb. 9, 2006.
Leopard Spots, (website) written by www.igt.com, printed Mar. 21, 2001.
Mega Multiplier, (website) written by www.wmsgaming.com, printed May 22, 2001.
Polly & Roger Advertisement written by VLC, Inc., published in 2000.
Take Your Pick Article written by Strictly Slots, published in Mar. 2001.
Top Cat Advertisement written by WMS Gaming, Inc., published prior to 2000.
Treasure Wheel/Treasure Tunnel Advertisement written by Sigma Game, Inc., published prior to 2000.
Wheel of Fortune printed from htt;://wikipedia.org/wheel__of__fortune on Feb. 9, 2006.
Wheel of Fortune printed from http//www.retrogames.co.uk/stock/assets/images/HH__-__wheel__of-fortune.jpg on Feb. 9, 2006.
Wheel of Fortune printed from http://en.wikipedia.org/wiki/Wheel__of__fortune on Feb. 9, 2006.
Wheel of Fortune printed from http://www.applelinks.com/reviews/wof.shtml on Feb. 9, 2006.
Wheel of Fortune, game manual for Nintendo, 1987.
Wheel of Fortune, game manual for Sony PlayStation, 1998.
X Factor Advertisement and Website Page written by WMS Gaming, Inc., published in 1998.
Yahtzee Video Game Advertisement, written by Mikohn Winning Solutions Worldwide, published 1999.

* cited by examiner

GAMING DEVICE HAVING AN INTERACTIVE SEQUENCE GAME WITH A MULTIPLE FUNCTION MULTIPLIER

PRIORITY CLAIM

This application is a divisional application of U.S. patent application Ser. No. 10/327,276, filed on Dec. 20, 2002, entitled "Gaming Device Having An Interactive Sequence Game With A Multiple Function Multiplier," the entire contents of which is hereby incorporated by reference.

CROSS REFERENCE TO RELATED APPLICATIONS

This application relates to the foIlowing co-pending commonly owned patent applications: "GAMING DEVICE HAVING AN INTERACTIVE SEQUENCE GAME WITH A MULTIPLE FUNCTION MULTIPLIER," Ser. No. 11/952,760, and "GAMING DEVICE HAVING AN INTERACTIVE SEQUENCE GAME WITH A MULTIPLE FUNCTION MULTIPLIER," Ser. No. 11/952,774.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates to a gaming device having an interactive sequence game with a multiple function multiplier.

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one known method for enhancing player enjoyment and excitement.

Gaming devices having bonus games generally employ a triggering event that occurs during the operation of the base game of the gaming device. The triggering event temporarily stalls or halts the base game play and enables a player to enter a second, different game, which is the secondary or bonus game. The player plays the bonus game, likely receives an award, and returns to the base game.

Bonus games exist that employ a wheel including several awards. A player spins the wheel to obtain one or more awards on the wheel. One such bonus game is the WHEEL OF FORTUNE® gaming device manufactured by the assignee of this application. In this game, a multi-colored award wheel is attached to the housing of the gaming device. The award wheel is divided into several sections. Each section includes an award that ranges in value from twenty-five to one thousand. In this game, a player plays a base game that includes spinning reels and a central payline. When the wheel symbol is positioned along the central payline on the third reel, the player enters the bonus game.

In the bonus game, the player obtains one opportunity or spin of the award wheel. The player spins the award wheel by pressing a button on the gaming device. Once the award wheel starts spinning, the player waits until it stops. An indicator located at the top of the award wheel points to a section of the wheel. The player receives the award on the indicated section for the bonus game. After the player receives that award, the bonus game ends and the player may resume playing the base game.

In other gaming devices, gaming device manufacturers provide excitement to players by using multipliers. A multiplier increases the award amount proportionally to the value of the multiplier. For example, a "2×" multiplier pays twice the normal award value. A "3×" multiplier pays three times the normal award value. A multiplier can substantially increase a player's award. Some games also employ an incrementing multiplier as described in the following paragraphs.

U.S. Pat. No. 6,004,207 discloses a slot machine that provides a multiplied payout when certain symbols or symbol combinations appear on the reels and a player bets the maximum amount of coins. This bonus game includes a plurality of reels including several symbols on the reels and a multiplier. The symbols include multiplier symbols and Power Point symbols. Initially, the bonus game sets the multiplier at a predetermined level. The multiplier increments by one level when the player obtains ten Power Point symbols on the reels from one or more spins. After the multiplier increases in value, the player needs ten more Power Point symbols to increment the multiplier again. The gaming device also enables a player to spin the reels to obtain a winning symbol combination. If the player obtains a winning combination, the gaming device provides the player with an award. If the winning combination includes a multiplier symbol, the award is multiplied by the multiplier. Once an award is multiplied by the multiplier, the multiplier resets to a predetermined level.

Another type of bonus game that includes a multiplied payout is the GOOD TIMES® gaming device which is manufactured by the assignee of this patent application. This game includes three reels having a plurality of symbols and blank spaces. The symbols include a plurality of "Good Times" symbols. The bonus includes two different multiplier groups. A first multiplier group starts at "1×" (or one times the award) and goes up to "12×" (or twelve times the award). The second multiplier group starts at "1×" and goes up to "144×" (or one hundred forty-four times the award). Each time a player spins the reels and obtains three blank spaces on a payline, the designated multiplier in each multiplier increments one level. When the player obtains a winning combination, the player receives an award. If a "Good Times" symbol appears in the winning combination, the player's award is multiplied by the designated multiplier in the first bonus table. If two "Good Times" symbols appear in the winning combination, the player's award is multiplied by the designated multiplier in the second bonus group.

Gaming devices that increase the opportunities to obtain awards and increase the size of the awards are desirable. Players are attracted to games that provide several larger awards and the opportunity to obtain a very large award. Therefore, to increase player enjoyment and excitement, it is desirable to provide new games for gaming devices.

SUMMARY OF THE INVENTION

The present invention relates to a gaming device having a game, and specifically to a gaming device having an award distributor, and an interactive sequence with a multiple function multiplier. In one preferred embodiment, the gaming device includes or displays an award distributor such as a wheel having several sections. The sections each include awards (or award symbols representing awards) such as values or any other suitable awards. A section indicator indicates one of the sections on the wheel. The gaming device provides a player with an activation award based on the award associated with the award symbol on the indicated section of the award distributor modified by a multiple function modifier such as a multiple function multiplier which is determined by the interactive sequence. Generally, the gaming device displays the sequence, which includes a plurality of groups having a plurality of elements or components to the player and randomly picks one of the groups in the sequence. The multiplier is based on the picked group and specifically, the number of elements in the picked group.

In one embodiment, the sequence includes a plurality of groups having a plurality of elements where at least one of the groups includes related elements. The related elements in such a group could be related in any suitable manner. In one aspect of this embodiment, all of the related elements are the same.

In one embodiment, the gaming device and particularly the processor, randomly picks one of the groups in the sequence. In another embodiment, the gaming device enables a player to pick one of the groups in the sequence. The multiplier increases by a predetermined or random amount for each element revealed in the sequence by the player in each activation or spin of the award distributor or wheel. In one embodiment, the award distributor indicates an award first, and then enables the player to pick groups in the sequence. It also should be appreciated that one of the groups may be picked first to determine the multiplier, before the award distributor indicates an award.

As described above, the sequence includes several groups of related elements such as groups of related symbols. The groups of related elements may be related in any suitable manner such as groups of numbers in a number combination or groups of letters in one or more words. In one embodiment, the groups include related letters arranged to form a word or words such as in a phrase. In other embodiments, the related elements are related numbers, related characters or other types of related symbols which are arranged in any suitable manner desired by the game implementer. Additionally, the gaming device displays a plurality of selections in a selection display. The groups in the sequence are associated with the selections in the selection display. Only the groups displayed in the sequence are included in the selections in the selection display. In another embodiment, the gaming device enables the player to pick the groups directly in the sequence.

Initially, the groups in the sequence and the groups associated with the selections in the selection display are masked or hidden from the player. The gaming device enables the player to pick one of the selections in the selection display to reveal a group. All of the related elements in the group in the sequence that correspond to or match the picked group revealed in the selection display are revealed to the player. In one example, if the sequence includes groups of related letters which form a plurality of words, the player picks a selection in the selection display to reveal one of the groups of related letters. In this example, each group includes the same or identical letters in the word. Therefore, if the player picks the letter "A," all of the "A's" in the sequence (i.e., the words) are revealed to the player.

The gaming device provides a modifier to the player based on the number of components in the group picked by the player. The modifier may be a multiplier or any suitable type of modifier. In one embodiment, the modifier is a multiplier, which is preferably a two function multiplier. The first function includes the picking of the group from the selections by the player. The second function includes the number of corresponding or related elements revealed in the sequence that match the element associated with the picked group. For example, if the player picks a selection that reveals a group having two related elements in the sequence, the player obtains a "3×" multiplier where the multiplier has an initial value of "1×." Thus, in one embodiment, the multiplier has a value of one and increases by one for each element associated with the picked symbol group. The multiplier may start at any value and also may change by any suitable amount. Additionally, in one embodiment, the multiplier accumulates in value and increases during the activations of the award distributor. In another embodiment, the multiplier is reset after one activation, a plurality of activations or any suitable number of activations of the award distributor. An activation award is provided to the player in each spin or activation of the wheel and is the value of the multiplier multiplied by the award indicated on the wheel. This activation award is added to any previous activation awards obtained by the player in the game.

In one embodiment, a multiplier display indicates the multiplier obtained by the player in a game. A total award display indicates the total award obtained by the player in the game. Additionally, the spins remaining display indicates the number of spins remaining in the game.

In another embodiment, a modifier is provided to the player based on the number of elements in a selected group. The modifier may be a positive value, a negative value or any other suitable value. Additionally, if a selected group includes several elements, the player receives several modifiers, which may be the same modifiers or different modifiers. In one aspect of this embodiment, the modifier is provided to the player for each of the elements in a selected group. In another aspect, the modifier is provided to the player for a plurality of elements in a selected group.

The player's goal is to obtain the highest possible award in the game. The player continues to spin the wheel and pick selections until the player does not have any activations or spins remaining in the game or until the player determines or solves the arrangement of elements displayed in the sequence. If the player determines or solves the particular arrangement of elements, such as one or more words or a phrase in the sequence, the player obtains an additional award which is added to the player's total award in the game. If the player cannot determine the word(s) or phrase, or the player incorrectly determines the word(s) or phrase, the player does not receive such additional award in the game. The game ends and the gaming device provides the player with the total award indicated in the total award display.

In another embodiment of the present invention, the sections on the award distributor wheel or wheel, and the selections include a number of risk factors or risk symbols. The risk symbols modify and specifically reduce or decrease the value of one or more of the elements or awards provided to the player in the game.

In one embodiment, the sections on the wheel include one or more risk symbols such as an eliminator symbol such as a BANKRUPT symbol, a lose partial symbol and a LOSE symbol. The eliminator or BANKRUPT symbol reduces the player's total award to zero in the game. In addition, the BANKRUPT symbol may act as a terminator symbol and end the game. In another embodiment, the BANKRUPT symbol only reduces the player's total award to zero and the player can continue playing the game. The lose partial symbol reduces the player's total award such as by one-third or in half or decreases another element in the game such as the multiplier or the number of activations or spins provided to the player. The LOSE symbol causes the player to lose symbols or letters indicated in the sequence and the awards associated with those awards or symbols in another embodiment. In another embodiment, the LOSE symbol causes the player to lose one or more activations or spins in the game, or ends the game without reducing the award. It should be appreciated the risk factors can be any suitable type of factor and that the risk symbols may modify one or more elements in a game.

In this embodiment, the gaming device includes at least two inputs, input devices or indicators such as a "end game" button or indicator and a "spin" button or indicator in communication with or controlled by the processor. The buttons, inputs or indicators enable the player to accept or reject their total award in the game. The player presses the spin button to obtain another activation or spin in the game (if the player has at least one activation or spin remaining in the game and wants to risk losing at least a portion of the player's accumulated award). The player presses the end game button to end the game and keeps any accumulated awards. This button is used where the player may risk losing all or a portion of their award by incorrectly determining the sequence. Additionally, in one alternative embodiment, an additional input is provided to the player such as a "solve" button which enables the player to choose to solve the sequence in a game after the player has accepted the total award accumulated by the player and ended the game by pressing the end game button. In one embodiment, the sequence is automatically solved and in another embodiment, the gaming device enables the player to attempt to determine or solve the sequence. Therefore, in each activation, a player has the option of accepting and keeping their total award (i.e., banking the total award) and enabling the sequence to be automatically solved or the player can attempt to determine or solve the sequence for an additional award. Also, the player can continue playing the game by pressing the spin button to spin the award distributor or award wheel again. By continuing to play the game, the player is risking losing all or a portion of their total award or all or a portion of the accumulated elements in the sequence. As a result, the player must make a decision in each activation whether to accept the total award that they have accumulated in the game or risk losing all or a portion of that total award to continue to play the game to obtain potentially larger awards.

The risk symbols may also be associated with the selections in the selection display. Thus, if the player picks a selection having one of the risk symbols, the player's award is reduced as described above. Additionally, one or more bonus awards or bonus symbols may be associated with the selections in the selection display. The bonus awards may provide at least one spin, free spin, free game or other award to the player. It should be appreciated that the risk symbols may be associated with the wheel, the selections, or any combination therein. In this embodiment, the player continues to spin the wheel until the player has no activations or spins remaining in the game or until the player determines or solves the arrangement of elements in the sequence. If the player determines the word(s) or phrase in the sequence, the player is provided with an additional award. Once the game ends, the player receives the total award indicated in the total award display.

In another embodiment, the award distributor includes at least one terminator or terminator symbol, which ends the game when the terminator symbol is indicated on the award distributor in an activation. In a further embodiment, the award distributor includes a plurality of terminator symbols.

In a further embodiment, the player manually touches or presses the element sections or locations in the sequence. After the player touches or presses one of these sections, all of the elements associated with the picked group are revealed to the player. In one embodiment, the multiplier increases by a designated amount such as one for each element (i.e., letter) associated with the picked group. The multiplier is then multiplied by the award indicated on the wheel to provide the player with an activation award for that activation or spin.

In a further embodiment, a relationship display is also included in a game, where the relationship display indicates a hint relating to the word(s) or phrase indicated in the sequence. The hint may be one or more words such as a "title" which indicates that the arrangement of elements in the sequence relate to a title such as the title of a book, movie or other item. The player continues to activate or spin the wheel and pick groups in the sequence until the player does not have any activations or spins remaining or until the player determines or solves the word or phrase indicated in the sequence. The game ends and the player receives the total award indicated in the total award display.

In another embodiment, the award distributor includes a column of sections where an indicator moves along the perimeter of the sections to indicate one of the sections in the column. It should be appreciated that the sections indicated by the indicator may be arranged in any suitable pattern desired by the game implementer. Additionally, one or more indicators may be used in the game.

It should be appreciated that the present invention could be employed as a primary game or a bonus game in a gaming device.

It is therefore an advantage of the present invention to provide a gaming device having a player interactive sequence.

It is another advantage of the present invention to provide a gaming device having a multiple function multiplier.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1A:
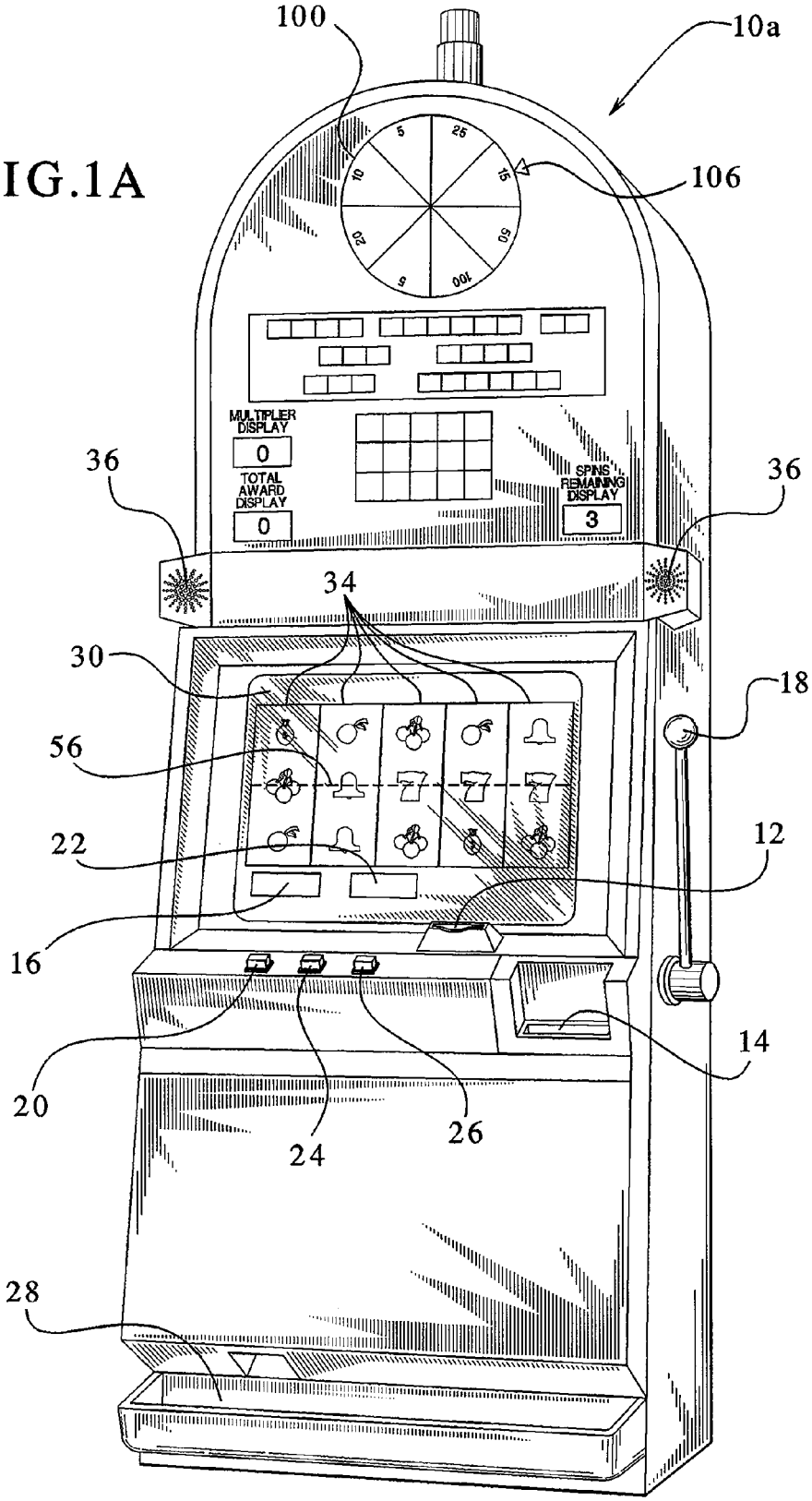
FIG. 1A is a front perspective view of one embodiment of the gaming device of the present invention.
Figure 1B:
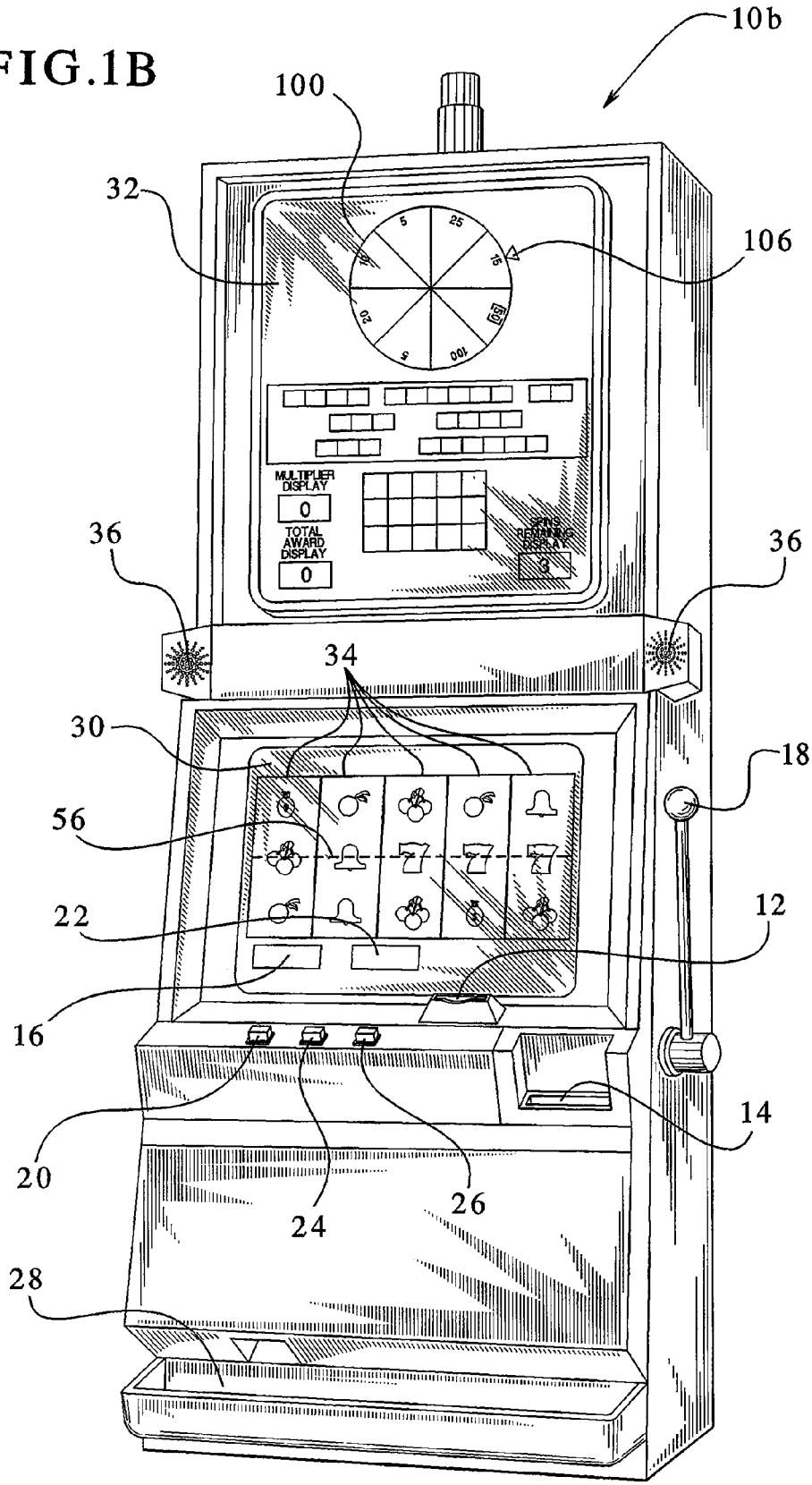
FIG. 1B is a front perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 in one embodiment has the controls, displays and features of a conventional slot machine. It is constructed so that a player can operate it while standing or sitting, and gaming device 10 is preferably mounted in a cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker, blackjack or keno, and any of the bonus triggering events and bonus games associated with these primary games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. Other bet or wager indicators such as a bet max button may also be employed in the gaming device of present invention.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, an upper display device 32, and the alternative embodiment shown in FIG. 1B includes a central display device 30 as well as an upper display device 32. Gaming device 10 in one embodiment displays a plurality of reels 34 such as three to five reels 34 in mechanical or video form at one or more of the display devices. A display device can be any viewing surface such as glass, a video monitor or screen, a liquid crystal display or any other display mechanism. If the reels 34 are in video form, the display device for the video reels 34 is preferably a video monitor. Each reel 34 displays a plurality of indicia such as bells, hearts, fruits, numbers, letters, bars or other images which preferably correspond to a theme associated with the gaming device 10. Furthermore, gaming device 10 preferably includes speakers 36 for producing sounds such as music.

Figure 2:
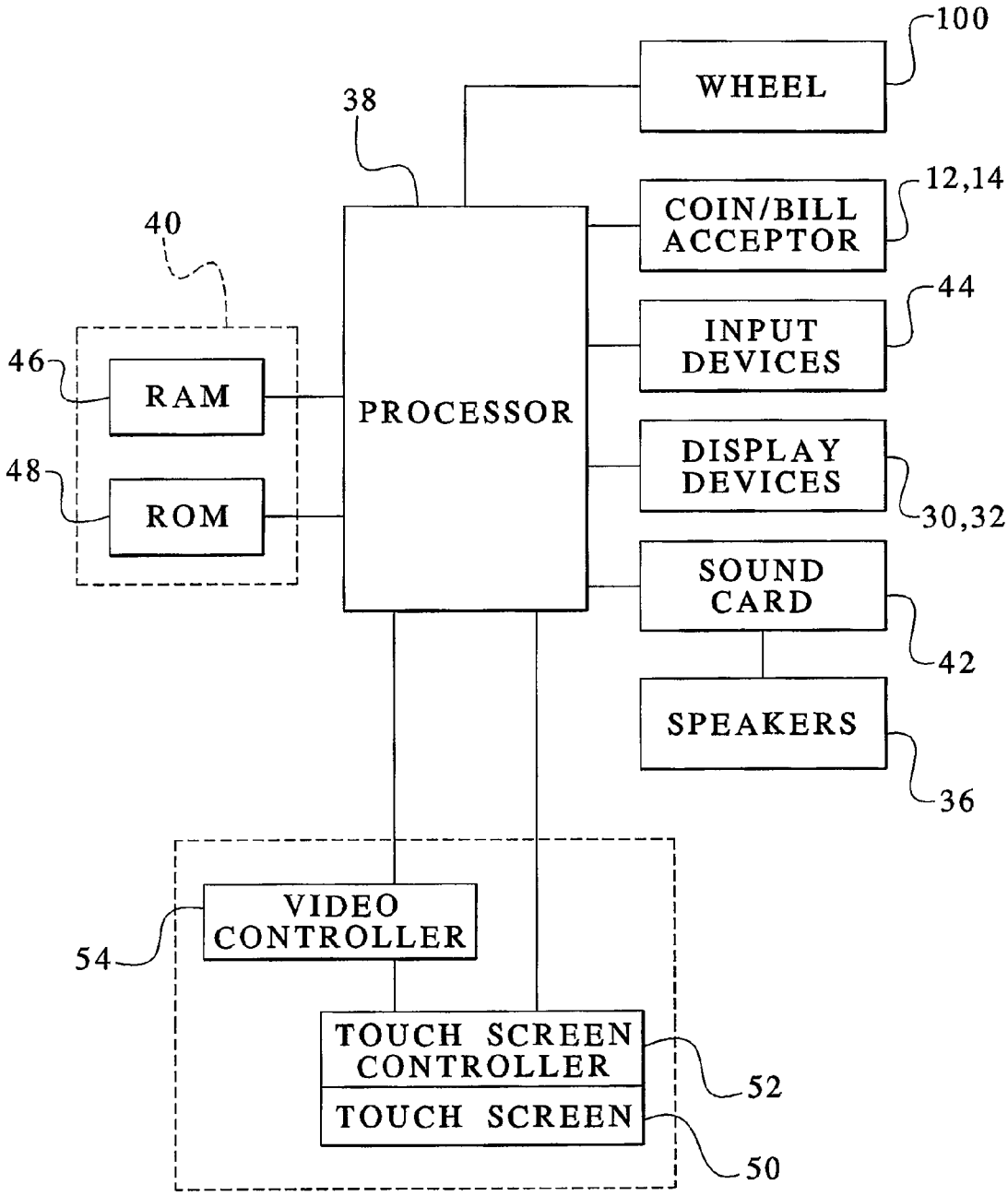
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a wheel 100; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. One or more secondary processors may also be employed in conjunction with the primary processor to control certain aspects of the game function. The memory device 40 can include random access memory (RAM) 46 for storing event data or other data 0generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10, in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, in one embodiment gaming device 10 also gives players the opportunity to win credits in a bonus round. This type of gaming device 10 will include a program which will automatically begins a bonus round when the player has achieved a qualifying condition in the game. This qualifying condition can be a particular arrangement of indicia on a display device. The gaming device 10 may use mechanical devices or a video-based central display device 30 to enable the player to play the bonus round. In one embodiment, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

In one embodiment of the present invention, if a player achieves a bonus triggering or qualifying condition during the primary game, the gaming device 10 initiates the secondary or bonus game of the present invention.

Figure 3:
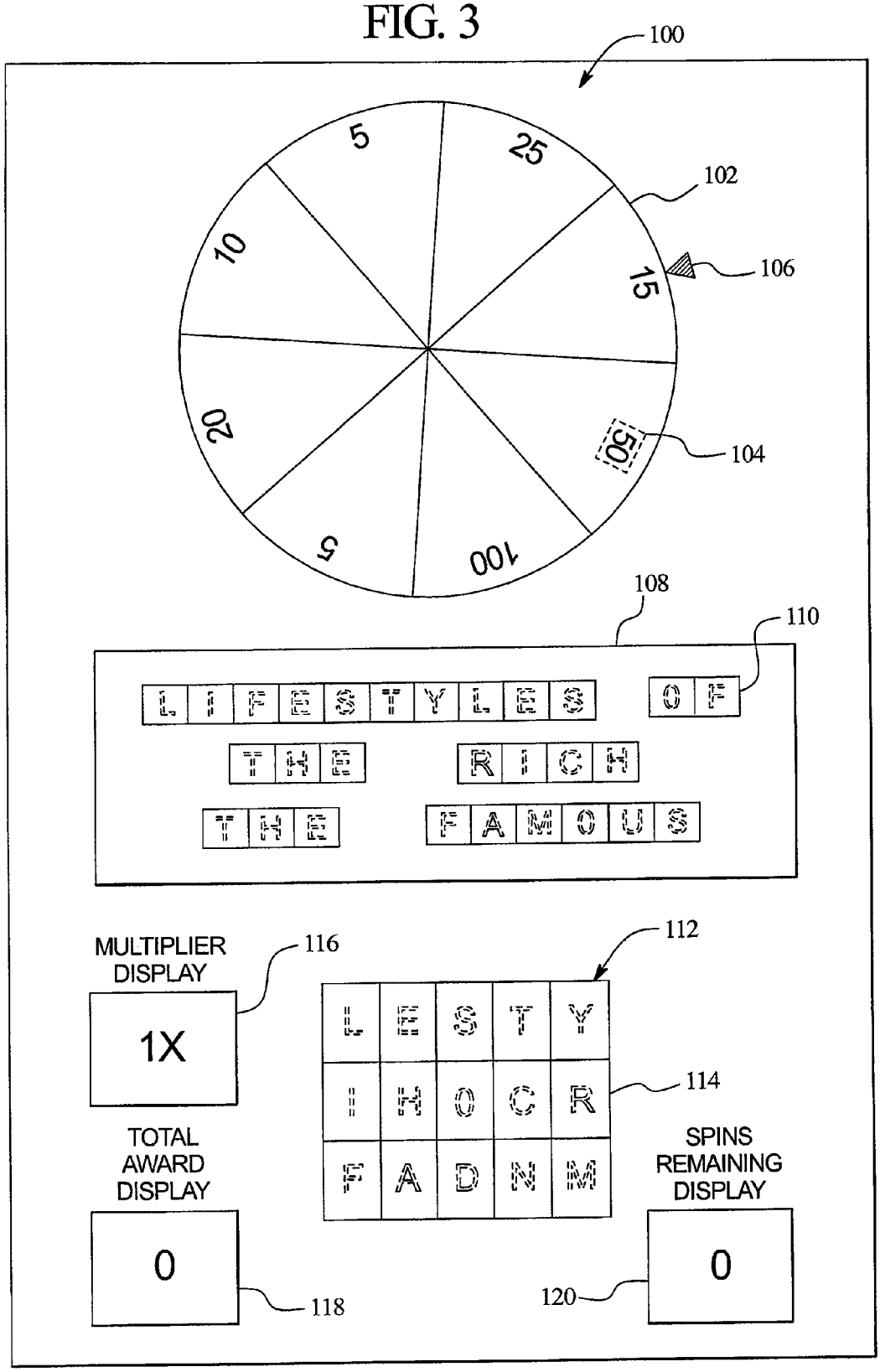
FIG. 3 is an enlarged front elevation view of one of the display devices of FIGS. 1A and 1B illustrating one embodiment of the present invention.

Referring now to FIG. 3, in one embodiment of the present invention, the bonus game includes an award distributor such as wheel 100 having a plurality of sections 102. An award symbol 104 is associated with each section 102, and at least one award is associated with each award symbol 104. In one embodiment, the awards are values such as the values illustrated on wheel 100 (i.e., 15, 50, 100, 5, 20, 10, 5 and 25). It should be appreciated that any suitable award may be used in the bonus game including, but not limited to, free games, free spins, multipliers and any combination therein. Additionally, in one embodiment, at least one of the sections includes a terminator or terminator symbol. In another embodiment, the sections of the award distributor include a plurality of terminators or terminator symbols.

An indicator 106 such as a section indicator indicates one of the sections 102 on wheel 100. The section indicator may be a pointer, an illumination device, a plurality of illumination devices or any suitable indicator. In one embodiment, the wheel spins in a clockwise direction as indicated by arrow 107. It should be appreciated that the wheel may rotate in a clockwise direction, counter-clockwise direction or any combination of clockwise and counter-clockwise directions. It should also be appreciated that wheel 100 may remain stationary and indicator 106 may move about the perimeter of wheel 100 in a clockwise direction, counter-clockwise direction or any combination therein. It should further be appreciated that both the wheel and the indicator may move simultaneously in the same direction (at different speeds) or in different directions.

In one presently preferred embodiment, a sequence 108 such as a puzzle forms one or more words or phrases and is displayed to a player. The sequence determines a modifier such as a multiplier provided to a player in a game by causing the processor to randomly pick one or more groups including related elements or symbols in the sequence. In another embodiment, the gaming device enables the player to pick the groups in the sequence. The multiplier provided to the player in each activation is based the number or type of elements associated with a picked group in a sequence. The sequence determines the value of the multiple function multiplier in each activation or spin. In this embodiment, the sequence includes groups of related elements such as symbols 110, in which the symbols may be letters, numbers, characters, pictures or any symbol as desired by the game implementer. In the illustrated embodiment, the groups include symbols 110 which are letters and are arranged in a predetermined order or combination in the sequence 108. For example, in FIG. 3 the groups of letters form the phrase "Lifestyles of the Rich and Famous." It should be appreciated that the groups may be arranged in any order desired by the game implementer. It should also be appreciated that the arrangement of symbols in this sequence or the words or phrase in this sequence may be randomly determined or selected by the processor in each activation or game. In this embodiment, the processor selects an arrangement of symbols, such as a word or phrase from a plurality of symbols, words or phrases. Initially, the groups of letters in the sequence 108 are hidden or masked from the player. The letters are revealed when the player picks selections 114 as described below.

In the presently preferred embodiment, a plurality of player selectable selections 114 are also displayed to the player in a selection display 112. The symbols 110 or letters in sequence 108 are associated with the selections 114. In a game, a player picks the selections to reveal matching symbols in the sequence. In FIG. 3, the letters (shown in phantom) are initially masked or hidden from the player. In a game, a player picks one of the selections 114 in each activation to reveal one of the letters. The gaming device then reveals the groups including at least one letter or several related letters that match the letter associated with the picked selection in the sequence 108. In one embodiment, all of the letters in sequence 108 that match the letter associated with the picked selection are revealed. In another embodiment, only one letter in the sequence that matches the letter associated with the picked selection is revealed. It should be appreciated that any number of letters or combination of letters may be revealed in the sequence.

In one presently preferred embodiment, the gaming device provides a modifier to the player where the modifier is based on the number of related symbols in a selected group. It should be appreciated that the modifier may be a multiplier or any other suitable modifier. In one embodiment, the modifier is a multiplier and is provided to the player in each activation or spin or in a plurality of activations of the award distributor. In this embodiment, the multiplier is determined based on two functions. The first function is variable and is based on the group picked by the gaming device or player in the sequence. A group includes one or more elements and at least one of the groups includes related elements. In one embodiment, the groups in the sequence represent the same (i.e., identical) symbols in the sequence. The first function of the multiplier is to determine and pick one of the groups in the sequence in each activation. The second function is also variable and is based on the number of related elements or symbols in the sequence 108 that match the element or symbol associated with the group picked by the player in each activation. It should be appreciated that the first and second functions of the multiplier may be variable, fixed or constant, or any combination thereof. In this embodiment, the multiplier increases for each related element or symbol in the group that matches the element or symbol associated with the group picked by the player. For example, if the player picks a selection 114 that reveals a symbol such as the letter "R", and the letter "R" appears four times in the sequence 108, the gaming device reveals that letter in the sequence and provides the player with a "4×" multiplier for that activation or spin. In another embodiment, the multiplier changes by a predetermined amount in each activation. In a further embodiment, the multiplier changes by a random amount in each activation. It should also be appreciated that the multiplier may change by a predetermined or random amount in each activation or in a plurality of activations. It should also be appreciated that the multiplier may increase, decrease or remain unchanged in each activation. Additionally in one embodiment, the multiplier accumulates in value and continues to increase during the activations of the award distributor in a game. In another embodiment, the multiplier is reset after at least one activation of the award distributor. In a further embodiment, the multiplier is reset after a plurality of activations of the award distributor. It should be appreciated that the multiplier may be reset after any suitable number of activations of the award distributor.

In the illustrated embodiment, a multiplier display 116 indicates the value of the multiplier provided to the player in a particular activation. The value indicated by the multiplier display is reset to a designated value such as 1× prior to the next activation. It should be appreciated that the reset value of the multiplier may be a randomly determined or pre-determined value. A total award display 118 indicates the total award accumulated by the player in a game. The total award indicated by total award display 118 at the end of the game is the award that is provided to the player. An activations remaining display or spins remaining display 120 indicates the number of activations or spins remaining in a particular game. When the spins remaining display indicates a zero, the game ends and the player is provided with the total award for that game.

In another embodiment, a modifier is provided to the player based on the number of components in a selected group. The modifier may a positive value, a negative value or any other suitable modifier. For example, if the selected group includes three components, the player will receive three modifiers for those components. The modifiers may be the same or different modifiers. In one aspect of this embodiment, the modifier is provided to the player for each of the elements in a selected group. In another aspect, the modifier is provided to the player for a plurality of elements in a selected group.

A player's goal is to obtain the largest possible award in the game. In a typical game, the player begins the game by receiving at least one activation or spin of the award distributor in the game. The number of activations or spins provided to the player at the start of the game may be predetermined, randomly determined or determined in some other manner. In one embodiment, a plurality of selections (not shown) are initially displayed to the player. A player picks one or more selections from the plurality of selections to obtain a number of activations or spins in the game. The number of spins provided to the player in the game is indicated by the spins remaining display 120. In one embodiment, the player begins the game with a base multiplier such as "1×." It should be appreciated however, that the multiplier may start at any suitable desired value including "0×." Additionally, the player does not start the game with an award as indicated by the total award display 118. It should be appreciated that one or more awards may be transferred from or dependent upon another game or games and provided to the player at the start of the game. It should also be appreciated that the award may be based upon a wager or wagers made by the player in the game and provided to the player at the start of the game.

In a game, the player uses the number of spins or activations to spin or activate the award distributor such as a wheel 100. In each activation, the indicator 106 randomly indicates one of the sections 102 on the wheel 100. The indicated section 102 includes an award symbol 104 which represents or includes the associated award. The award may be a value such as a number of credits or a symbol, which designates an award. The player then picks one of the selections 114 from the selection display 112, which are initially hidden or masked to the player, to reveal a group including an element or symbol such as a letter 110 as shown in FIG. 3. The letters 110 in sequence 108 that match the letter associated with the picked selection 114 are revealed and displayed to the player. In one embodiment, the elements or symbols 110 are letters which form a word, several words or a sequence or phrase such as "Lifestyles of the Rich and Famous" shown in FIG. 3. Each picked selection 114 reveals one of the letters in the phrase. In one embodiment, if a letter occurs multiple times in the sequence or phrase (i.e., a group of related letters), then each matching letter is revealed in the sequence. In another embodiment, only a predetermined number of related letters such as one matching letter is revealed in the sequence. In this embodiment, the letter revealed in the sequence may be randomly determined by the processor or predetermined by the processor such as revealing the first occurrence of the letter in a word or phrase.

In one embodiment, the gaming device provides the player with a multiplier for each activation of the award distributor or wheel. As described above, the multiplier is based on two functions. The functions include picking a group of related letters (i.e., a group of related letters) in the sequence and revealing a number of the related letters in the sequence 108. For example, the multiplier "1×" indicated in multiplier display 116 increases by one for each letter in sequence 108 that matches the letter associated with the selection 114 picked by the player. For example, if the player picks a selection 114 that reveals the letter "L", the player will obtain a multiplier of "3×" in that activation because there are two "L's" in the sequence 108. The new multiplier is then indicated in multiplier display 116. As a result, the award indicated on the wheel 100 is multiplied by the multiplier indicated in multiplier display 116. The resultant or modified award (i.e., activation award) is transferred to the total award display 118. The player continues to pick selections 114 from the selection display 112 in each activation until every letter 110 is revealed in the sequence 108 or until there are no activations or spins remaining in the game. At the end of the game, the player receives the total award indicated in total award display 118. In another embodiment, the player receives an additional award when the player correctly identifies or determines the word(s) or phrase displayed in the sequence 108. The additional award is added to the player's total award indicated by the total award display 118. In a further embodiment, the gaming device provides an additional award to the player when the player picks selections 114, which reveal all of the letters in the sequence 108 (i.e., determines or solves the sequence). In another embodiment, the gaming device provides the player with a multiplier having the greatest possible value for each of the remaining spins in the game when the player reveals all of the letters in the sequence.

Referring now to FIGS. 4A to 4D, an example of the embodiment of FIG. 3 is illustrated where the player begins the game with three activations or spins as indicated by the spins remaining display 120. The sequence 108 includes a plurality of groups including elements such as symbols 110 that are initially masked to the player. In this example, the symbols 110 are letters in the sequence 108 which form the phrase "Lifestyles of the Rich and Famous." The player starts the game with a base multiplier of "1×" as indicated by multiplier display 116 and an award of zero as indicated by the total award display 118.

Figure 4A:
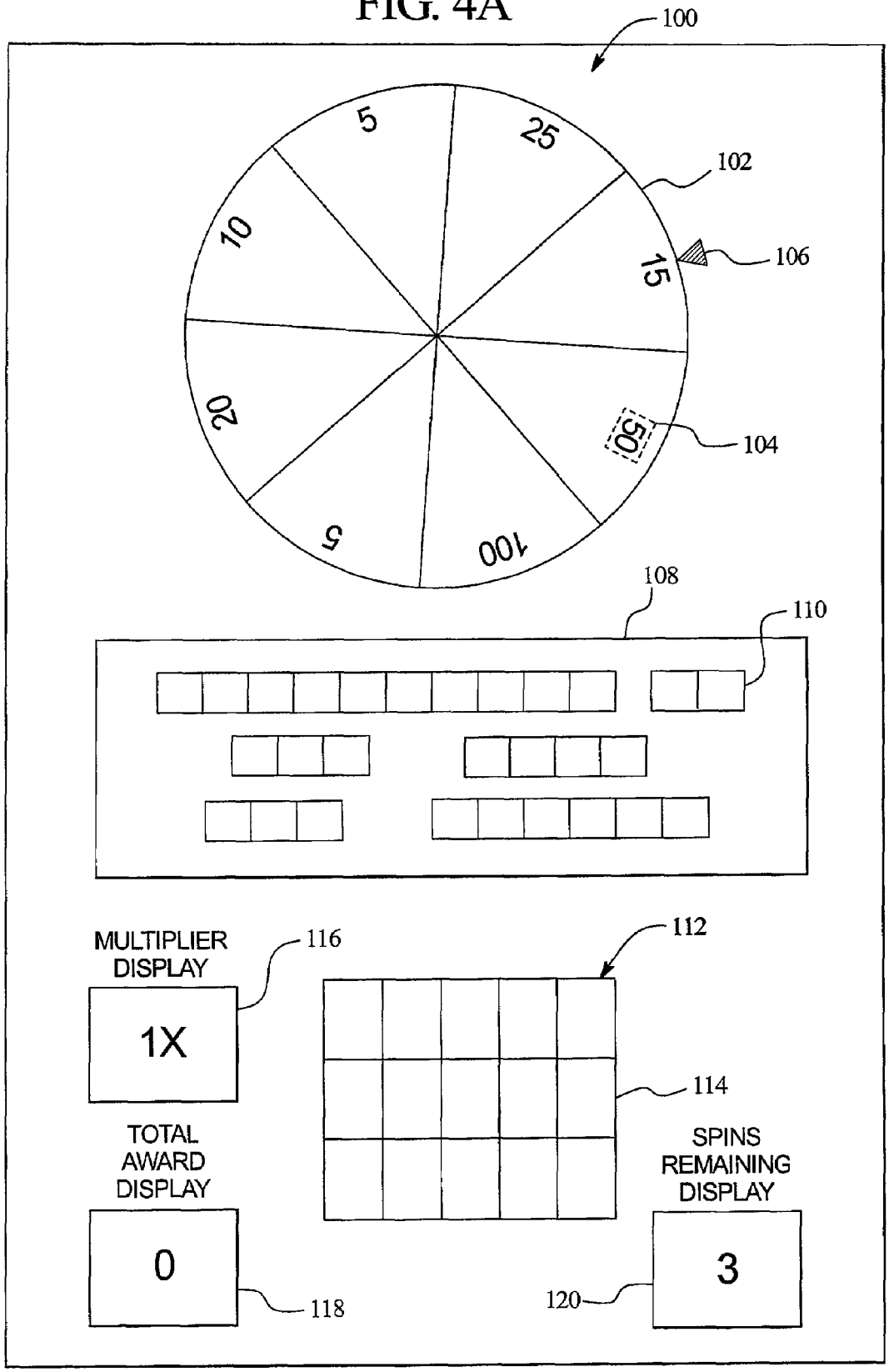
FIGS. 4A, 4B, 4C and 4D are enlarged front elevation views of one of the display devices of FIGS. 1A and 1B illustrating an example of the embodiment of FIG. 3 where the player has three spins in the game.
Figure 4B:
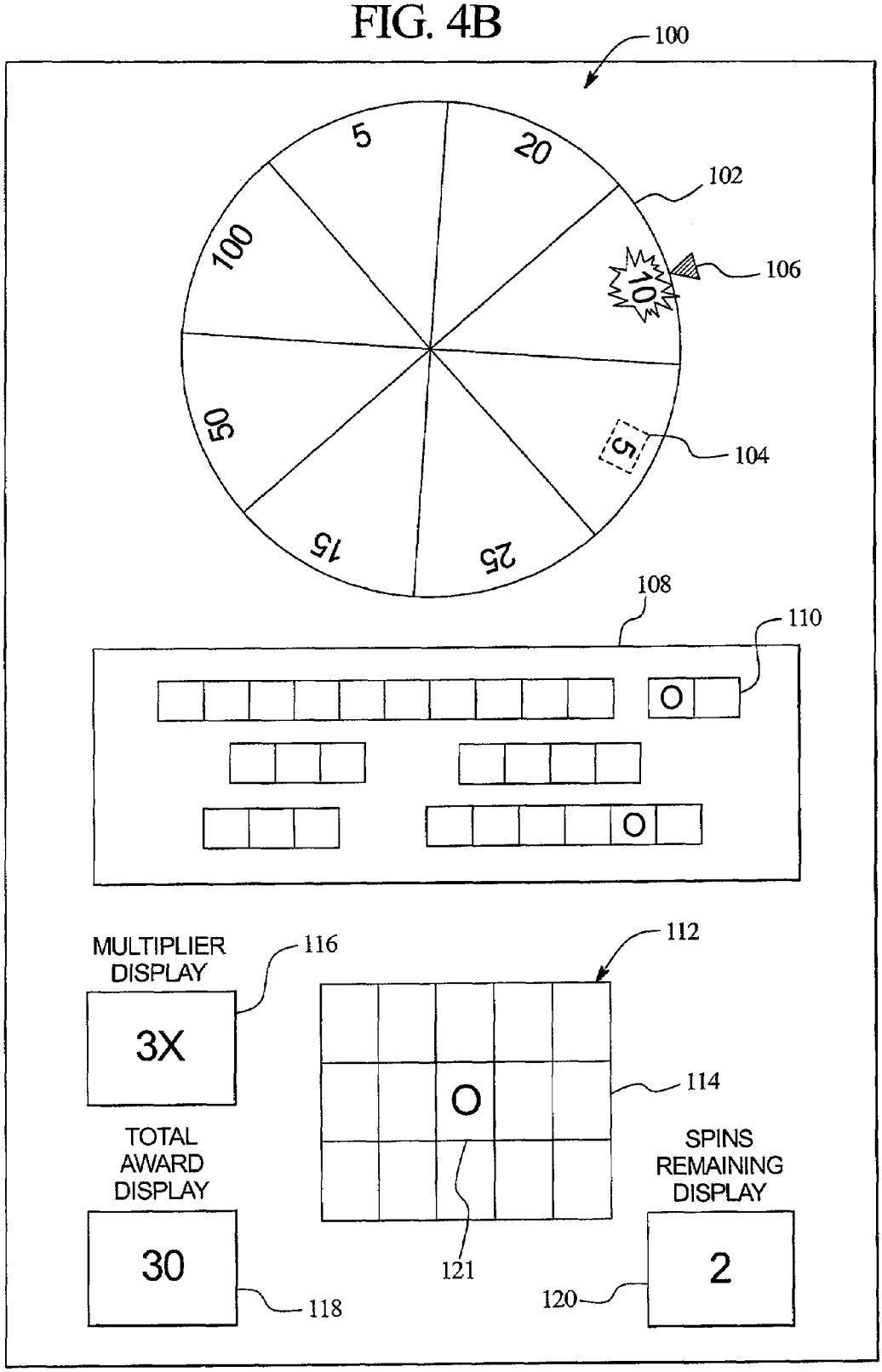

Referring to FIG. 4B, the player first activates or spins the wheel 100. Indicator 106 randomly indicates a value of ten associated with the indicated section 102 on the wheel 100.

The player now picks one of the selections 114 to determine the value of the multiplier for that activation. It should be appreciated that the award wheel may indicate an award before or after the value of the multiplier is determined for an activation of the wheel. The player picks selection 121, which is the first function in determining the multiplier, where the picked selection reveals the letter "O." The second function in determining the number of times that the letter "O" is revealed in the sequence or phrase. The letter "O" appears twice in the phrase "Lifestyles of the Rich and Famous." Thus, the player receives a "3×" multiplier as indicated by multiplier display 116 because two letters (i.e., the letter "O") in the phrase match the letter associated with selection 121 picked by the player. The indicated value of ten is multiplied by the multiplier value "3×" to provide an activation award of thirty for that activation or spin of the wheel. The activation award of thirty is added to the player's previous total award of zero, to give the player a new total award of thirty as indicated by the total award display 118. The player now has two spins remaining in the game as indicated by spins remaining display 120.

Figure 4C:
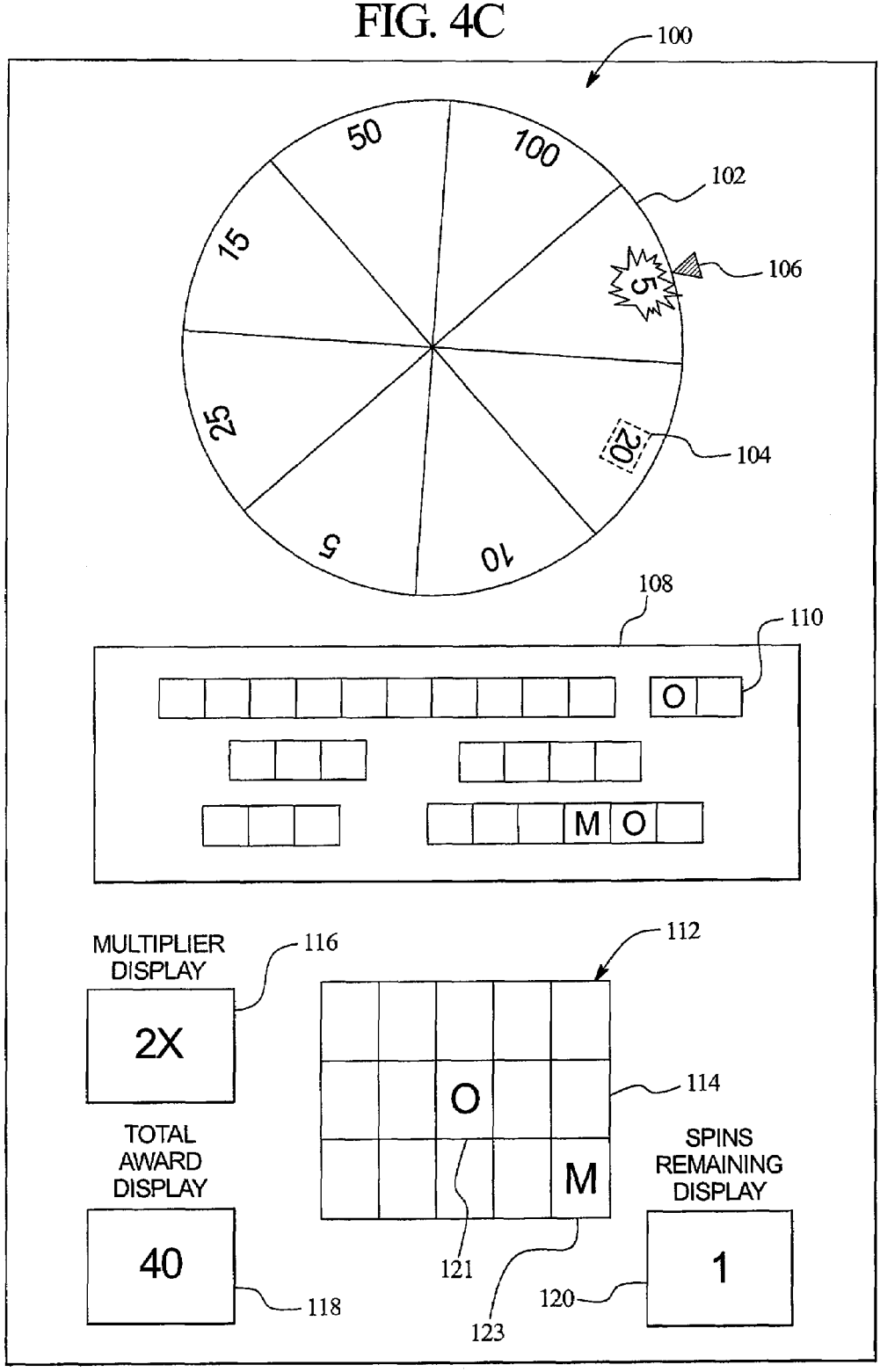

Referring to FIG. 4C, the multiplier is reset to a value of "1×" and the player spins the wheel 100 for a second time in the game. The indicator 106 indicates a value of five associated with one of the sections 102 on the wheel 100. The player now picks another selection 114 from the selection display 112. The player picks selection 123 which reveals the letter "M." The letter "M" only appears once in the phrase "Lifestyles of the Rich and Famous." Therefore, the player base multiplier of "1×" is increased to a "2×" multiplier for this activation. The indicated value of five is multiplied by the multiplier "2×" to provide an activation award of ten for this activation. The activation award of ten is added to the player's previous total award of thirty to give the player a new total award of forty as indicated by the total award display 118. The player has only one spin remaining in the game as indicated by the spins remaining display 120.

Figure 4D:
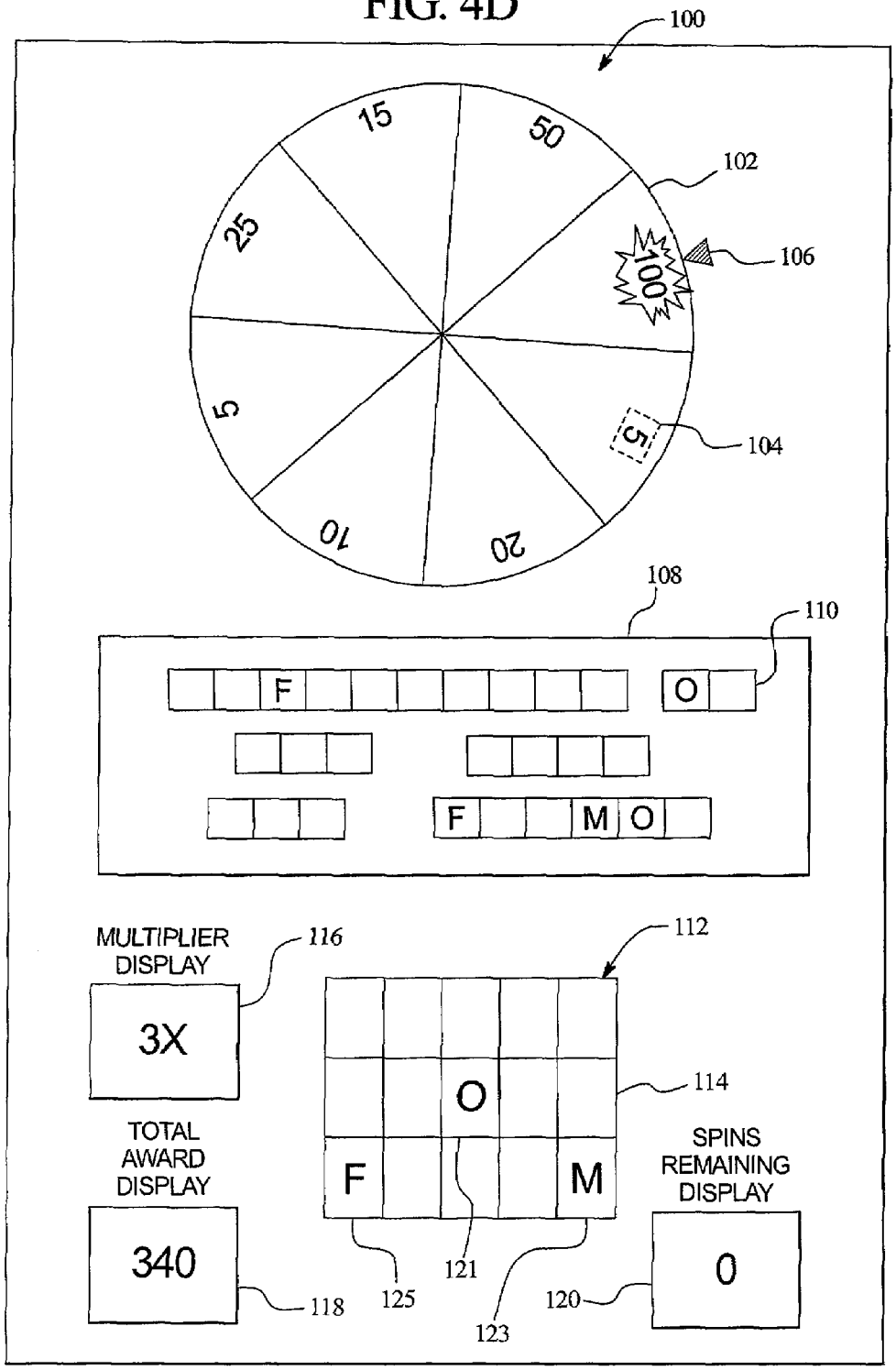

Referring to FIG. 4D, the multiplier is reset to a value of "1×" and the player spins the wheel again to obtain another activation award. In this spin, the indicator 106 indicates a value of one hundred associated with one of the sections 102 on wheel 100. The player picks a third selection 125 which reveals the letter "F." The letter "F" occurs twice in the phrase "Lifestyles of the Rich and Famous." Therefore, the base multiplier is increased from "1×" to "3×" where the multiplier of "3×" is provided to the player as indicated by multiplier display 116 for this spin of the wheel. The indicated award of one hundred is multiplied by the multiplier "3×" to obtain an activation award of three hundred for this spin. The activation award of three hundred is added to the player's previous total award of forty to obtain a new total award of three hundred forty as indicated by the total award display 118.

The player does not have any spins remaining in the game as indicated by the spins remaining display 120. Therefore, the game ends and the player obtains the total award indicated by the total award display 118. The player may opt to determine the phrase indicated in sequence 108 at the end of the game.

In one embodiment, the player presses or touches an input such as a button on the gaming device to solve or determine the phrase indicated by the sequence 108. In one embodiment, if the player correctly identifies or determines the phrase indicated in sequence 108, the player receives an additional award which is added to the player's previous total award indicated in the total award display 118. If the player does not correctly determine the phrase in sequence 108, the game ends and the player obtains the award indicated in the total award display 118. In another embodiment, if the player does not correctly determine the phrase, the game ends and the player loses all or a portion of the total award indicated by the total award display 118.

Figure 5:
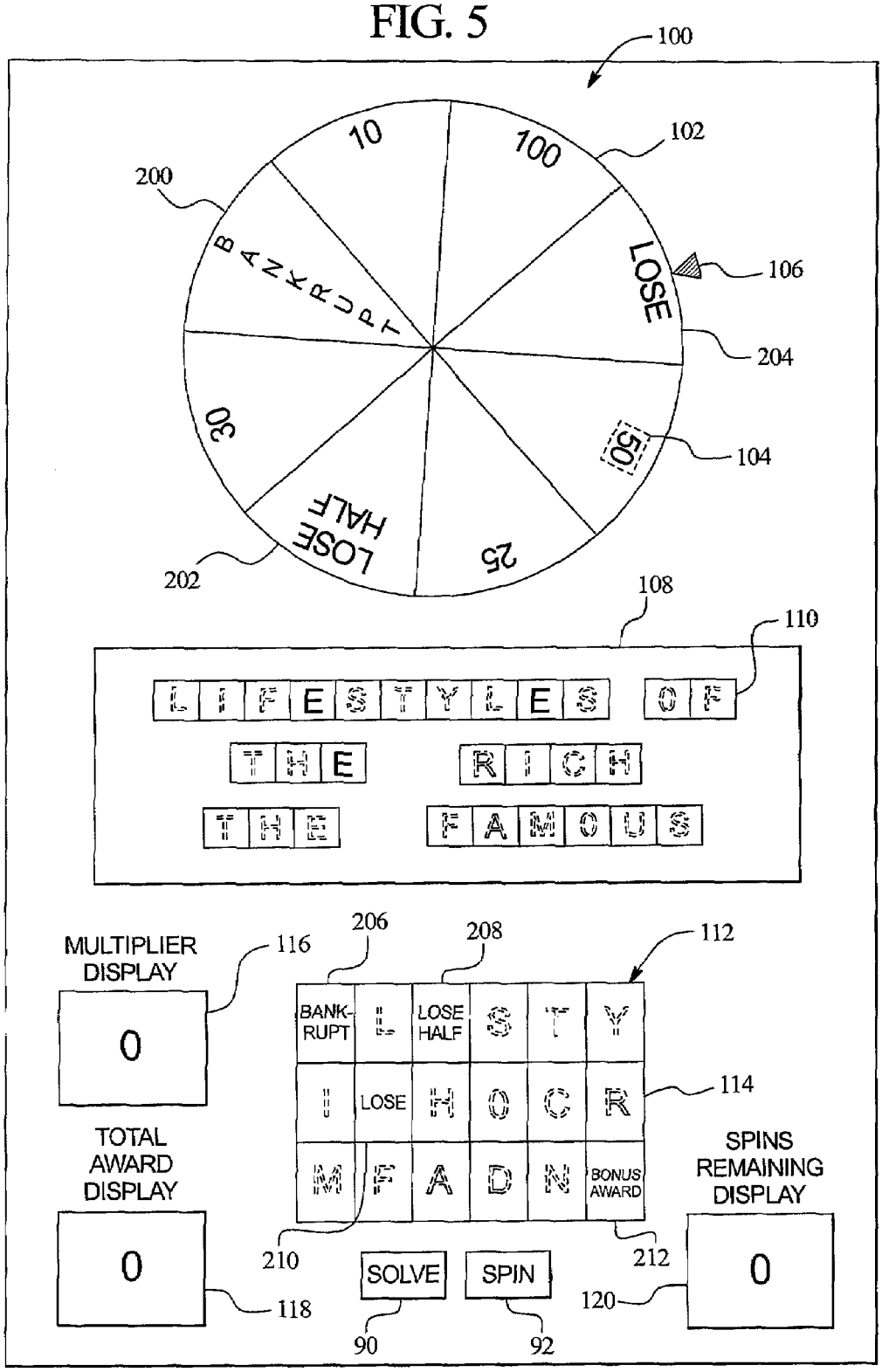
FIG. 5 is an enlarged front elevation view of one of the display devices of FIGS. 1A and 1B illustrating another embodiment of the present invention where the wheel and the selections include risk symbols.

Referring now to FIG. 5, another embodiment of the present invention is illustrated where the wheel 100 and the symbol selections 114 include risk symbols such as an eliminator symbol such as a "BANKRUPT" symbol 200, a lose partial symbol such as a "LOSE HALF" symbol 202 and a "LOSE" symbol 204. In this embodiment, the wheel 100 includes a plurality of sections 102. Several award symbols 104 are associated with the sections 102. The award symbols may include awards such as values (i.e., 50, 100) or modifiers (not shown) such as multipliers. In addition, at least one risk symbol is associated with one of the sections on the wheel. A risk symbol negatively affects the awards, symbols or activations in the game. Therefore, the risk symbols provide an element of risk to the game, which increases player enjoyment and excitement.

Additionally, in this embodiment, the gaming device enables the player to accept or reject the player's total award accumulated at any point in the game. The gaming device includes at least two inputs such as an end game button (not shown), a "solve" button 90 and a "spin" button 92. The end game button enables a player to end a game at any point in the game and receive the total accumulated award at that point in the game. This button is generally used in a game including risk symbols where a player decides to receive a total award, instead of risking all or a portion of that total award. The "solve" and "spin" buttons 90 and 92, respectively, enable the player to either solve or determine the sequence 108 by pressing the "solve" button 90 or continue playing the game by pressing or activating the "spin" button 92. If the player presses or activates the "solve" button 90, the player chooses to determine or solve the sequence 108 and thereby gains an additional award if the player solves or determines the sequence 108 correctly. In one embodiment, the player presses the solve button at a specific point in the game to solve the sequence. In another embodiment, the player presses the solve button after pressing the end game button to solve the sequence. In another embodiment, the "solve" button 90 also acts as the end game button and enables the player to end the game and accept the total award displayed in the total award display 118.

If the player opts to press or activate the "spin" button 92, the player risks losing all or a portion of their total award in the game because of the risk symbols located on the wheel and in the selections. Therefore, the player has the option in each activation whether to accept their present award and receive that total award for the game or reject their present total award and continue to play the game and possibly obtain more awards or lose awards. In one embodiment, the average award increases in each activation or spin so that the player obtains larger awards the further that the player progresses in a game.

As described above, in one preferred embodiment, the risk symbols include an eliminator symbol such as the "BANKRUPT" symbol 200, a lose partial symbol such as the "LOSE HALF" symbol 202 and a "LOSE" symbol 204. In one embodiment, the "BANKRUPT" symbol 200 causes the player to lose any awards the player has accumulated in a game when the "BANKRUPT" symbol is associated with an indicated section on the wheel. Therefore, if the "BANKRUPT" symbol 200 is indicated in an activation or spin, the player loses the total accumulated award indicated in the total award display 118 and the game ends. In another embodiment, the player also loses the total accumulated award indicated in the total award display 118. However, the game does not end and the player continues to play the game if there are any activations remaining.

In one embodiment, if a lose partial symbol such as the "LOSE HALF" symbol 202 is indicated on the wheel, the player loses a portion, such as half or fifty percent, of one or more elements in the game. It should be appreciated that the percentage of the loss may be any suitable percentage. In one embodiment, the "LOSE HALF" symbol 202 reduces the number of activations or spins that the player has remaining in the game. For example, if the player has four spins remaining in the game, the "LOSE HALF" symbol reduces the number of spins from four spins to two spins remaining in the game. This reduces the player's opportunity to obtain more awards in the game. In another embodiment, the "LOSE HALF" symbol reduces the award indicated on the wheel in the next spin or in the next several spins. As a result, the awards obtained by the player in subsequent spins are reduced. In a further embodiment, the "LOSE HALF" symbol reduces the total award in half. Thus, the player loses half of the award that the player has accumulated in the game up to that point.

In another embodiment, the "LOSE HALF" symbol reduces the number of symbols in the selection display 112. For example, if there are six selections remaining and each selection includes a different symbol or letter in the sequence 108, the "LOSE HALF" symbol reduces the number of selections to three or reveals three of the selections to the player. The player therefore cannot pick those selections and loses any awards that might be associated with picking those selections. It should be appreciated that in this embodiment, the specific selections that are revealed by the processor may be randomly determined or predetermined, such as revealing the selections in a particular order such as starting from the left and moving to the right.

In a further embodiment, the "LOSE HALF" symbol reduces the available groups including the elements such as the symbols or letters in the sequence 108. For example, if there are four letters that have not been revealed in the sequence 108, the gaming device reveals two of those letters in the sequence. In this embodiment, each occurrence of the letter in sequence 108 would be revealed whether the number of occurrences is one, two or several occurrences in the sequence 108. In a further embodiment, the processor reveals half of the letters that are remaining in the sequence 108. For example, if ten letters 110 are remaining in the sequence 108, the gaming device or processor reveals five of those letters to the player. The letters which are revealed may be randomly selected or a predetermined sequence of letters in a sequence 108. Revealing the letters in the sequence 108 reduces the player's opportunity to accumulate more and larger awards in the game. In one aspect of this embodiment, the processor reduces the number of vowels remaining in the sequence 108 in half. Therefore, if four vowels are remaining in the sequence 108, the processor reveals two of those vowels and thereby reduces the player's opportunity to obtain awards associated with those letters. In another aspect of this embodiment, the processor reduces the number of consonants in the word(s) or phrase in sequence 108 in half. In a further embodiment, the processor reduces the award associated with letters that are already revealed in the sequence 108 when the "LOSE HALF" symbol is indicated on the wheel. In this embodiment, the player loses half of the award associated with the letters that are revealed in the sequence 108. For example, in FIG. 5, if the player revealed the letter "F" in the phrase "Lifestyles of the Rich and Famous," the player obtains an award associated with the letter "F." Since the letter "F" occurs three times in that particular phrase, the player obtains three times the indicated award on the wheel for that particular activation. Therefore, if the indicated award was ten and the player received an award of thirty when the player picked the letter "F," the award of thirty would be reduced in half to fifteen. The reduction of the award to fifteen would be subtracted from the player's total award in the game and the player would now have a smaller total award.

If the "LOSE" symbol 204 is associated with an indicated section on the wheel, the player loses something of value or potential value in the game. In one embodiment, if the indicator 106 indicates a section 102 including the "LOSE" symbol 204, the player loses one, a plurality or all of the spins or activations remaining in the game and the game ends. The player obtains or receives the total award displayed in the total award display 118. In another embodiment, the player loses one or more groups of symbols 110 or letters in the sequence 108. In this embodiment, if the player loses a group of letters or symbols from the sequence 108, the player loses the associated value of that group. Thus, the lost value is subtracted from the total award displayed in the total award display 118. In further embodiments, the player loses all of the groups of symbols or letters 110 revealed in sequence 108. Therefore, the player is less likely to determine the word or phrase indicated in sequence 108.

In another embodiment, if the indicator 106 indicates the lose symbol 204, the player loses the opportunity to determine the word or phrase indicated in symbol display 108. In this embodiment, the processor randomly generates a new group of symbols 110, or letters, which are arranged into a new word or phrase in the sequence 108. Thus, the player has to start from the beginning with a new word or phrase in sequence 108. However, the player keeps the same number of spins indicated in the spins remaining display 120. The player's chance of determining the word or phrase indicated in sequence 108 becomes more difficult and the player is less likely to determine the word or phrase indicated in the symbol display 108. In further embodiments, the player loses all of the vowels, all of the consonants or all of the letters revealed in sequence 108. In these embodiments the player may lose only the vowels, consonants or letters in the sequence or the player may additionally lose the awards associated with the vowels consonants and letters in the sequence that were provided to the player when the player picked those letters.

If the indicator 106 indicates a section that includes an award symbol 104, the player obtains the award associated with that award symbol. The awards may include values, modifiers such as multipliers, free games, free spins, credits or any suitable award desired by the game implementer.

In one presently preferred embodiment, the selection display 112 includes a plurality of selections 114 that include symbols such as letters (illustrated in FIG. 5), or risk symbols such as the "BANKRUPT" symbol 206, "LOSE HALF" symbol 208 and "LOSE" symbol 210. The "BANKRUPT" symbol 206, "LOSE HALF" symbol 208 and "LOSE" symbol 210 trigger functions in the game as described above when the risk symbol is associated with a selection picked by the player from the selection display 114. Additionally, a bonus award symbol 212 may be associated with one of the selections 114 in the selection display 112. The bonus award symbol 212 may provide the player with at least one free spin, free game, multiplier, award, value or credit in the game.

The risk symbols provide an element of risk to the game such that the player may lose one or more awards, letters or spins accumulated by the player in the game. Thus, there is added excitement and enjoyment of the game because the player risks the awards, letters and spins earned by the player in the game to continue to play the game and potentially obtain more awards. Additionally, the player risks continuing playing the game versus solving or determining the arrangement of symbols or letters 110 in sequence 108. In the illustrated embodiment in FIG. 5, the gaming device provides a "solve" button 90 and a "spin" button 92. As described above, the "solve" button 90 enables the player to accept their present total award and attempt to solve the sequence 108. If the player determines or solves the sequence 108, the player obtains at least one additional award in the game. The additional award is added to the player's total award and the player receives the new total award for the game. In another embodiment, the player loses a portion or all of their award if they incorrectly determine or solve the sequence 108. In this embodiment, the "solve" button 90 enables a player to either accept their total award and end the game or risk their total award or a portion of the total award and attempt to solve or determine the sequence 108. If the player wants to continue to play the game and the player has activation or spins remaining in the game, the player can choose to activate or press the "spin" button 92 to activate or spin the award wheel 100 another time. Plus, the player risks losing all or a total portion in the game by continuing to play the game. However, the player may receive an additional award or awards in the game by continuing to play the game. Alternatively, in another embodiment, the player continues to play the game until the player obtains one or more risk symbols that ends the game or until the player has no spins remaining. The total award indicated in the total award display 118 at the end of the game is the award that is provided to the player.

Figure 6A:
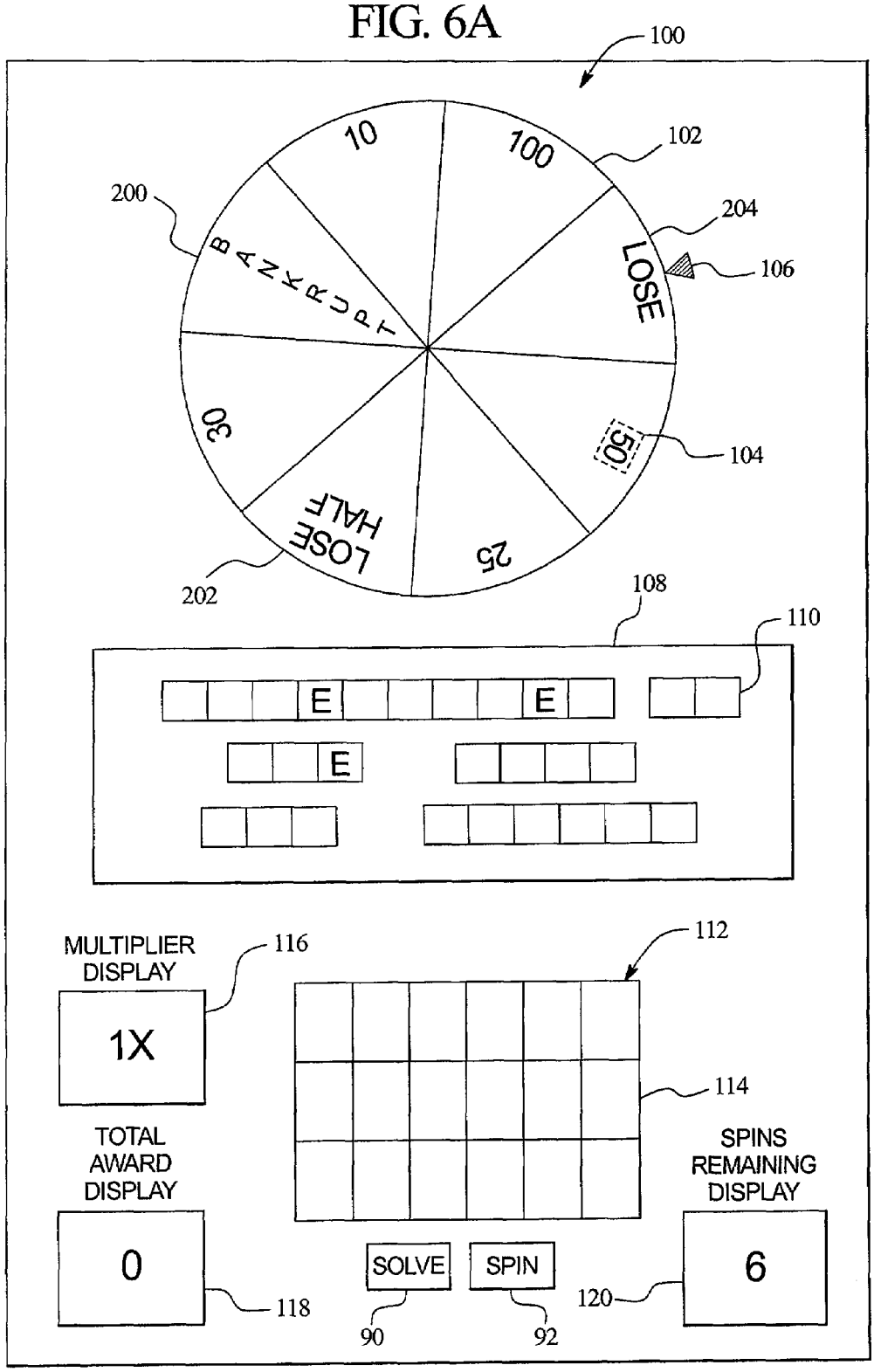
FIGS. 6A to 6I are enlarged front elevation views of one of the display devices of FIGS. 1A and 1B illustrating an example of the embodiment of the FIG. 5 where the player begins the game with six spins.

Referring now to FIG. 6A, an example of the embodiment of FIG. 5 is illustrated where the player is provided with six activations or spins of the award wheel 100 to begin a game. The wheel 100 includes sections 102 having risk symbols such as an eliminator symbol or "BANKRUPT" symbol 200, a lose partial symbol or "LOSE HALF" symbol 202 and "LOSE" symbol 204. The sections 102 on the wheel 100 also include several award symbols 104 having values such as credits, free spins, free games or any suitable value. The sequence 108 displays a plurality of letters 110, which form the phrase "Lifestyles of the Rich and Famous." In this embodiment, one letter, the letter "E," is initially displayed to the player. Thus, the player cannot obtain any awards associated with the letter "E" in this game. However, the player obtains the benefit of already having this letter displayed in the sequence 108 so that the player has a better opportunity to determine the phrase in sequence 108. Additionally, the gaming device provides a solve button 90, which in this example, enables the player to accept their total award and end the game or solve the sequence 108. The gaming device also provides a "spin" button 92 which enables the player to press the spin button and activate or spin the award wheel 100 for an additional spin or spins.

The selection display 112 includes a plurality of selections 114 that are masked or hidden from the player at the start of the game. The selections 114 as illustrated in FIG. 5, include one or more risk symbols and also include the letters associated with the phrase indicated in sequence 108. Furthermore, the multiplier display 116 indicates the value of the multiplier at the start of the game, which is "1×." In this example, the multiplier is reset to 1× after each activation of the reels in the game. The player also starts the game with a total award of zero as indicated by the total award display 118. The gaming device provides the player with six spins at the beginning of the game as indicated by the spins remaining display 120. The player uses the six spins to spin the wheel 100 in the game.

Figure 6B:
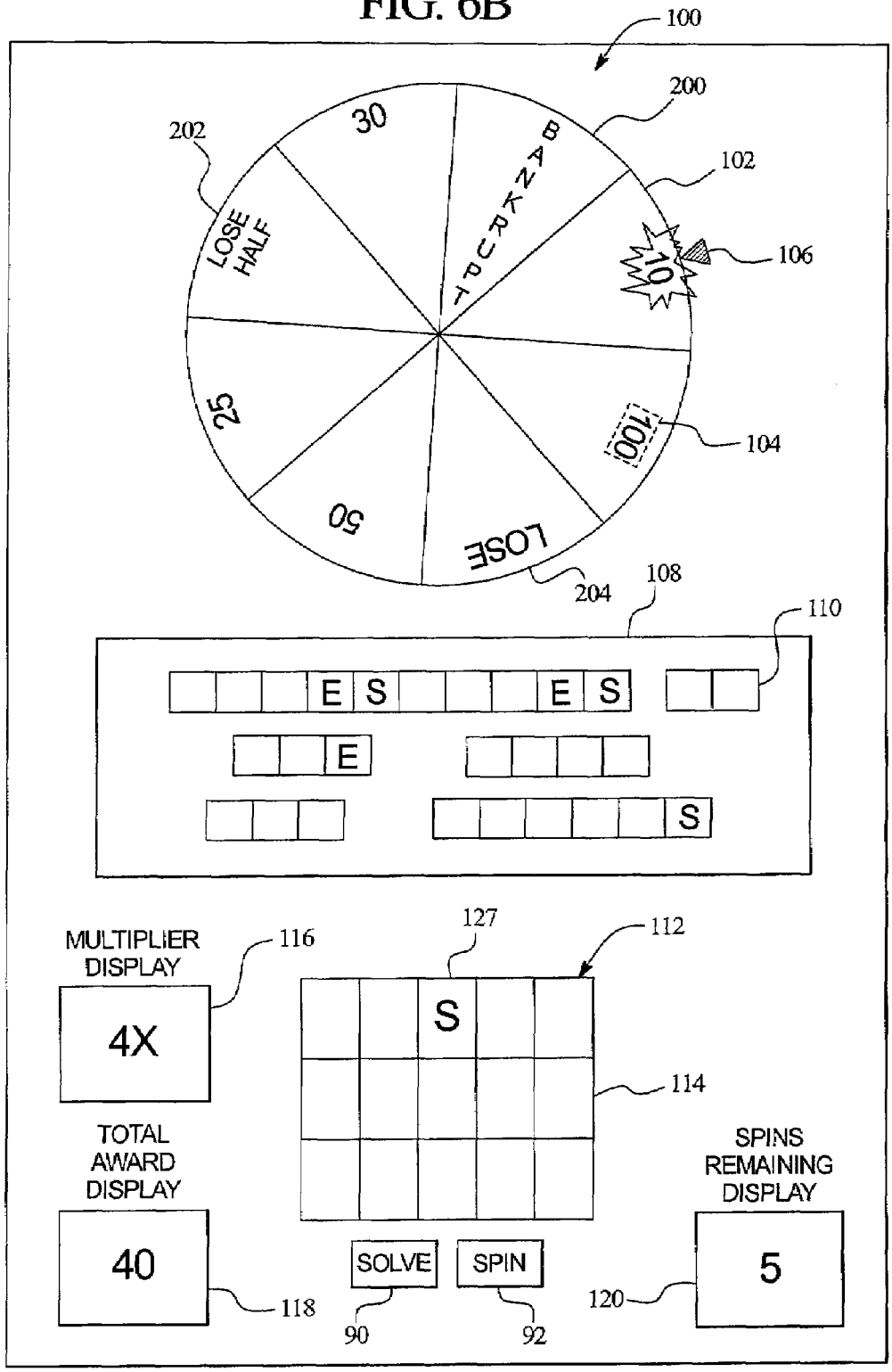

Referring now to FIG. 6B, the player uses their first spin in the game to spin the wheel 100. After the wheel stops spinning, the indicator 106 indicates section 102, which includes an award of ten. The player now selects one of the selections 114 from the selection display 112. The player picks selection 127 which reveals the letter "S." The letter "S" occurs three times in the phrase displayed in sequence 108. Because the player picked a letter that appeared three times in the phrase in sequence 108, the player obtains a "4×" multiplier as indicated by multiplier display 116. The "4×" multiplier is determined by increasing the initial multiplier of "1×" by one for each of the three letters revealed in the sequence. The indicated award of ten is multiplied by the multiplier "4×" to provide the player with an activation award of forty for this spin. Since this is the first spin, the activation award is added to the total award of zero to provide a new total award of forty as indicated by the total award display 118. The player has five spins remaining in the game as indicated by the spins remaining display 120. The player has now revealed a few letters in the phrase in sequence 108. However, the player is not yet able to solve or determine the phrase displayed in sequence 108. Therefore, the player presses or activates the "spin" button 92 and opts to spin or activate the wheel again. Each time the player spins the wheel 100, the player risks losing all or a portion of the total award, letters or spins obtained by the player in the game because of the risk symbols associated with the sections on the wheel and the selections in the selection display 112.

Figure 6C:
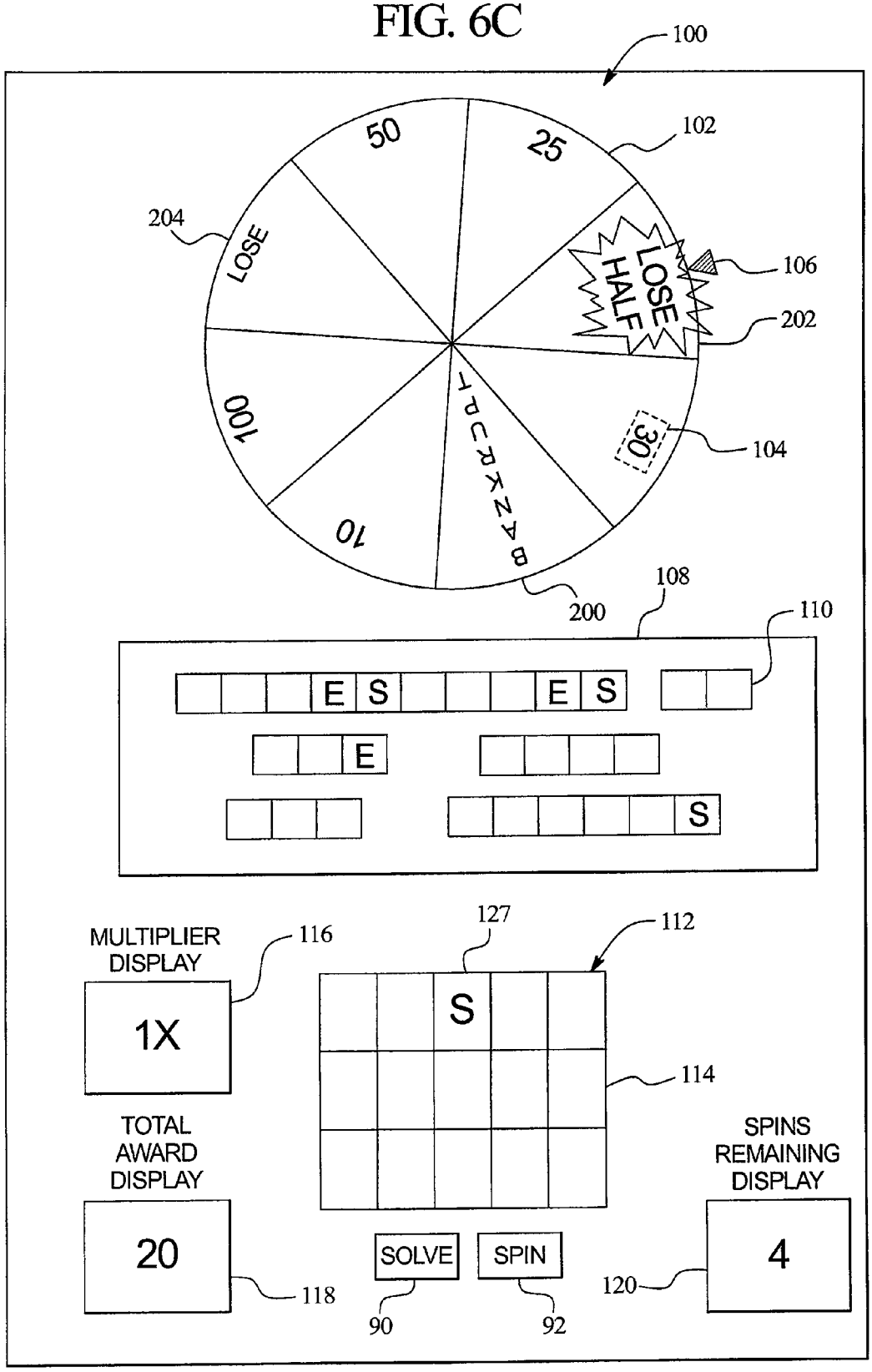

Referring now to FIG. 6C, the player spins the wheel for a second time in the game and the indicator 106 indicates a section which includes the "LOSE HALF" symbol 202. In this example, the "LOSE HALF" symbol 202 reduces the player's total award by half as indicated in total award display 118. The player had a total award of forty and now the total award is reduced to twenty. As described above, the "LOSE HALF" symbol 202 may also reduce the total number of letters revealed in the phrase, reduce the multiplier, or reduce any award, symbol or other suitable factor in the game as desired by the game implementer. The player did not obtain any additional letters in the phrase displayed in sequence 108 and therefore is still not able to determine the phrase displayed in sequence 108. The player now has four spins remaining in the game as indicated by the spins remaining display 120. The player activates or presses the "spin" button 92 and spins the wheel again to try to obtain more awards in the game.

Figure 6D:
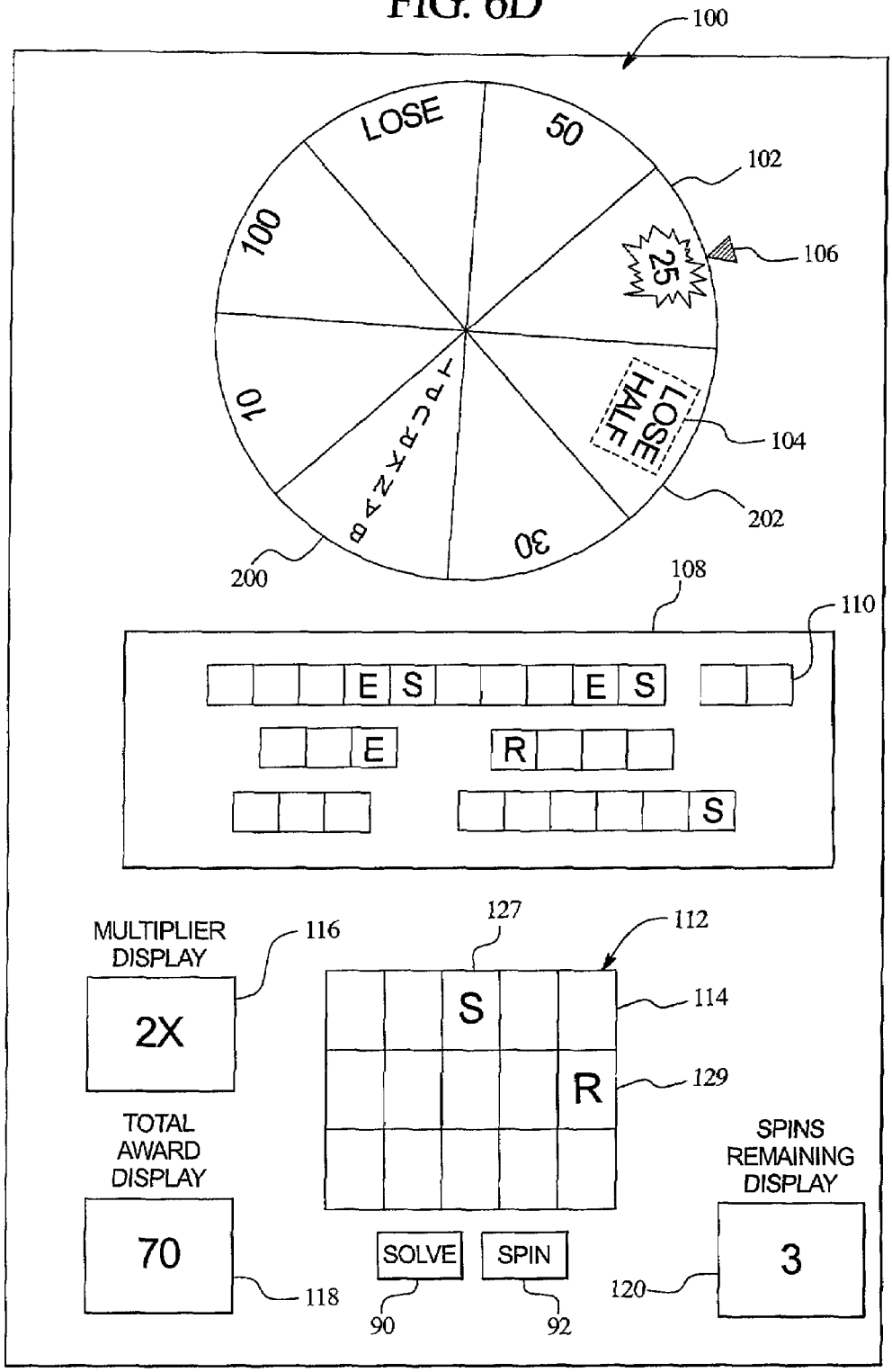

Referring to FIG. 6D, the player spins the wheel for a third time in the game. The indicator 106 indicates a section 102 having an award of twenty-five. The player now selects another selection 114 from the selection display 112. The player selects selection 129 which reveals the letter "R." The letter "R" occurs once in the phrase displayed in sequence 108. Therefore, the player obtains a "2×" multiplier as indicated by the multiplier display 116. The indicated award of twenty-five is multiplied by the multiplier "2×" to give the player an activation award of fifty for that spin. The player's new total award is seventy, which is the sum of the activation awards of fifty obtained in this spin, plus the player's previous activation award of twenty. The player now has three spins remaining in the game as indicated by the spins remaining display 120. Although the player now has more letters displayed or revealed in the phrase displayed in sequence 108, the player still is not able to solve or determine the phrase. The player also wants to try to obtain more awards in the game. Therefore, the player presses the "spin" button 92 to activate or spin the wheel again to attempt to obtain more letters in sequence 108 and more awards in the game.

Figure 6E:
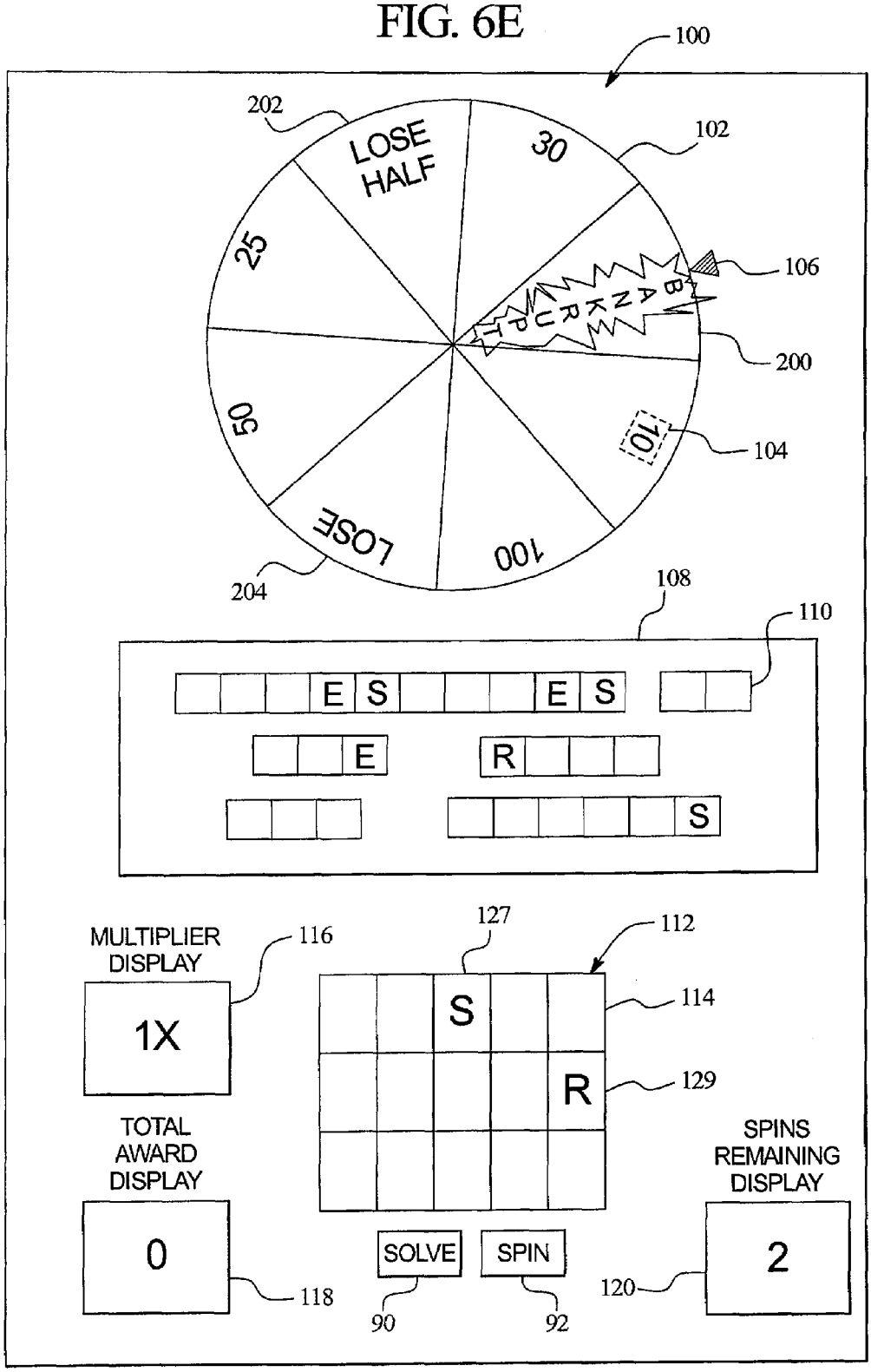

Referring now to FIG. 6E, the player spins the wheel for a fourth time in the game and the indicator 106 indicates a section 102 having the "BANKRUPT symbol" 200. In this example, the "BANKRUPT" symbol eliminates the player's total award indicated in the total award display 118. It should be appreciated that, the "BANKRUPT" symbol 200 may end the game, eliminate the player's multiplier or eliminate all of the letters from the phrase indicated in the symbol display 108 or perform some other function as described above. In this example, the "BANKRUPT" symbol 200 eliminates the player's total award in the game or reduces the player total award to zero as indicated by the total award display 118. There is no award or value associated with the "BANKRUPT" symbol, therefore, the player's total award is zero. The player has two spins remaining in the game as indicated by spins remaining display 120. Because the player's total award is zero and thereby has nothing to lose in the game, the player chooses to press the "spin" button and spin the wheel again.

Figure 6F:
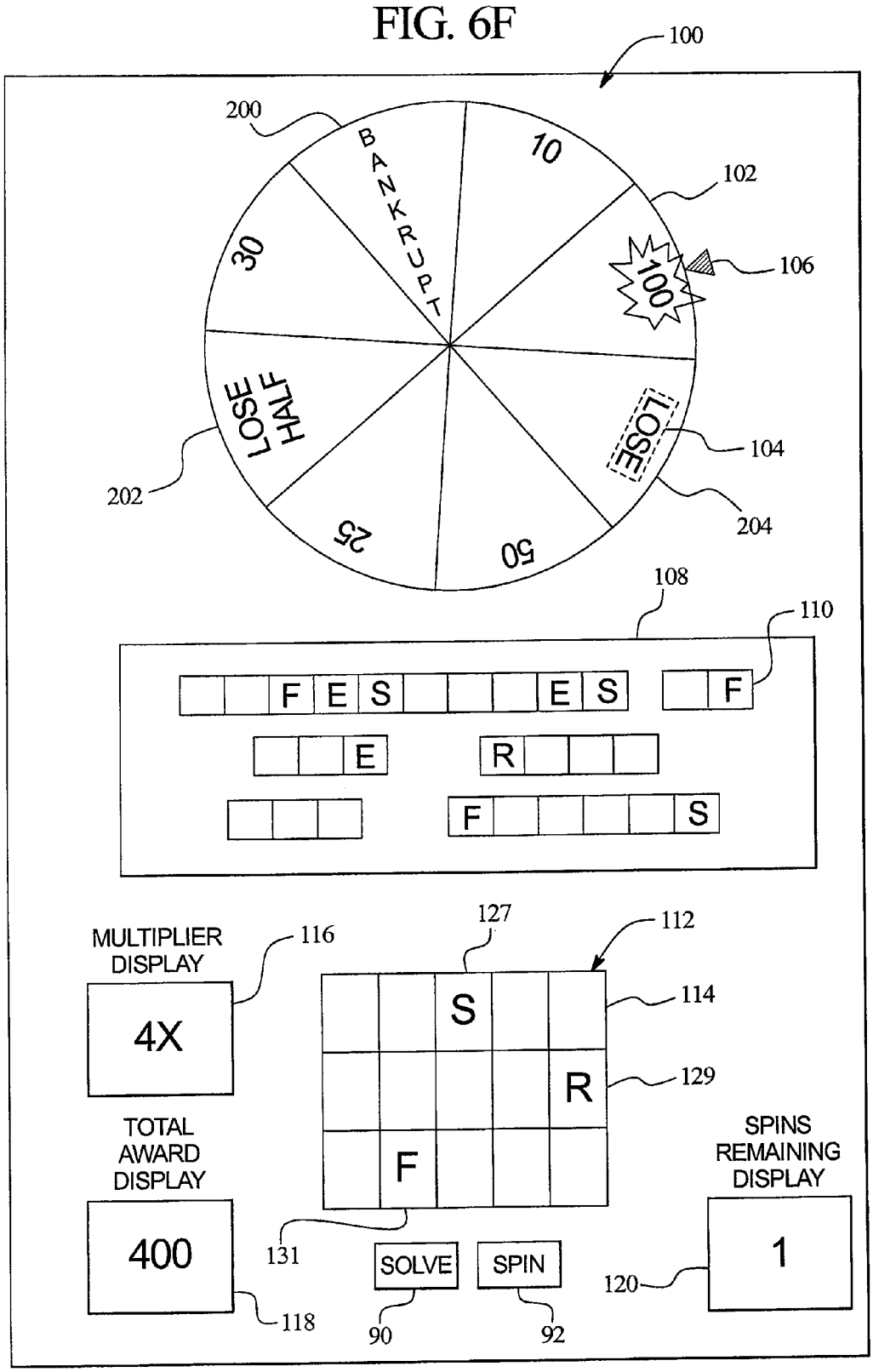

Referring to FIG. 6F, the player spins the wheel 100 for a fifth time in the game. The indicator 106 indicates an award of one hundred. The player now picks another selection 114 from the selection display 112. The player picks selection 131 which reveals the letter "F." The letter "F" occurs three times in the phrase displayed in sequence 108. The player obtains a "4×" multiplier as indicated by the multiplier display 116 because the player obtained three "F" symbols or letters in the phrase displayed in sequence 108. The indicated award of one hundred is multiplied by the multiplier of "4×" to provide the player with an activation award of four hundred for this spin. The player's total award for the game is the activation award of four hundred obtained in this spin, plus the total award from the previous spins which was zero. Therefore, the player's total award is now four hundred as indicated by the total award display 118. The player has only one spin remaining in the game as indicated by the spins remaining display 120. The player is still unable to determine the phrase indicated in symbol display 108. At this point, the player may choose to solve the sequence, keep their total award or spin the wheel again. In this example, the player presses the "spin" button to spin the wheel 100 another time.

Figure 6G:
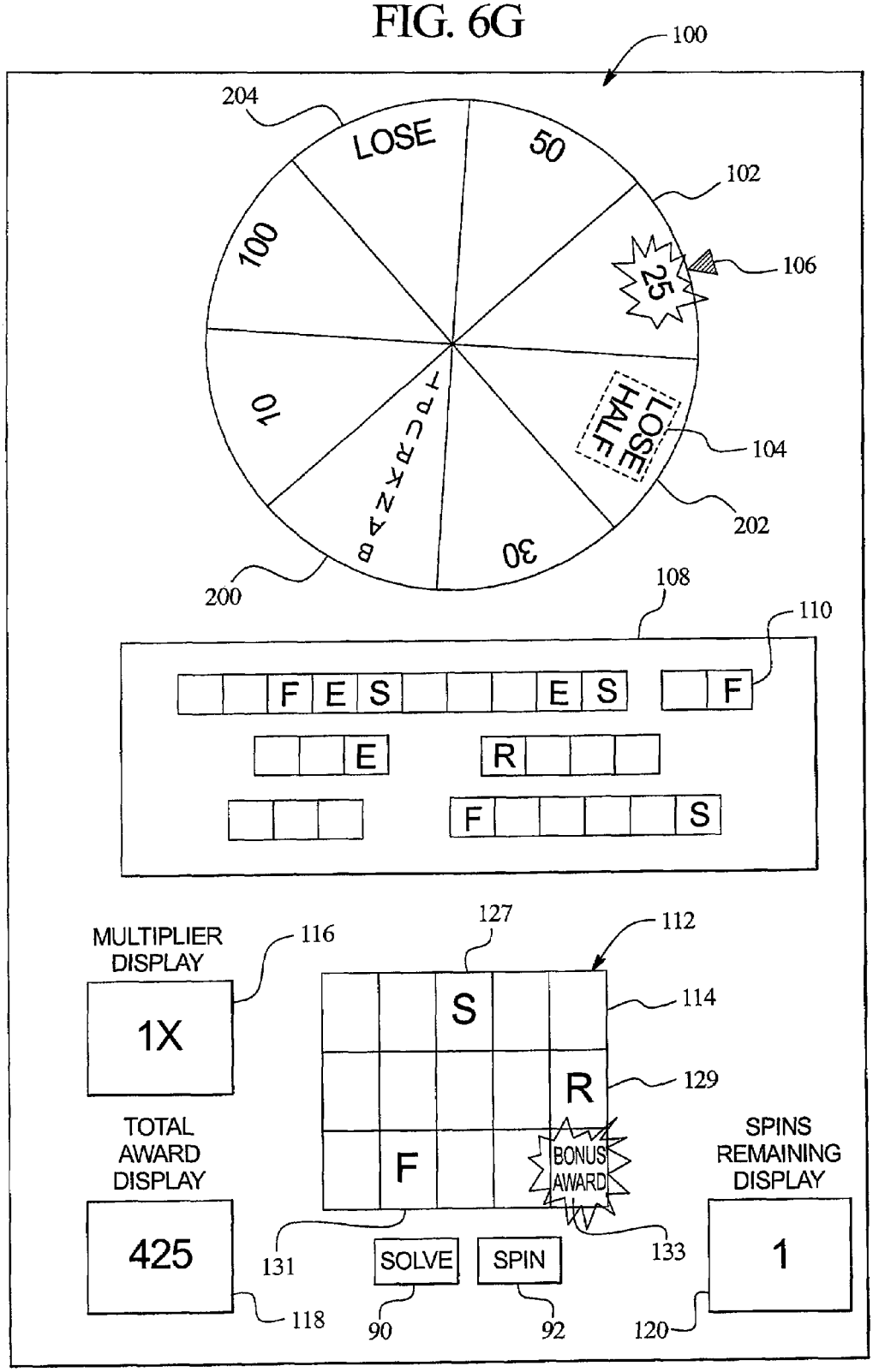

Referring to FIG. 6G, the player spins the wheel 100 and the indicator 106 indicates a section having an award of twenty-five. The player now picks another selection 114 from the selection display 112. The player picks selection 133 which reveals a bonus award. In this example, the bonus award is one free spin in the game. It should be appreciated that the bonus award may be any award including at least one free spin, one free game, one or more multipliers or any other award desired by the game implementer. Additionally, the player also obtains the award indicated by indicator 106. Thus, the player obtains an activation award of twenty-five in the spin in addition to the one free spin obtained by the player for picking the bonus award. The player's new total award is four hundred twenty-five as indicated by the total award display 118. The total award is based on the activation award of twenty-five obtained in this spin plus the total award from the previous spins which was four hundred. The player now has one spin remaining in the game as indicated by spins remaining display 120. The player did not obtain any additional letters in the phrase indicated in sequence 108. As a result, the player is still unable to determine the phrase indicated in sequence 108. The player decides to continue playing the game and presses the "spin" button 92 to spin the wheel again.

Figure 6H:
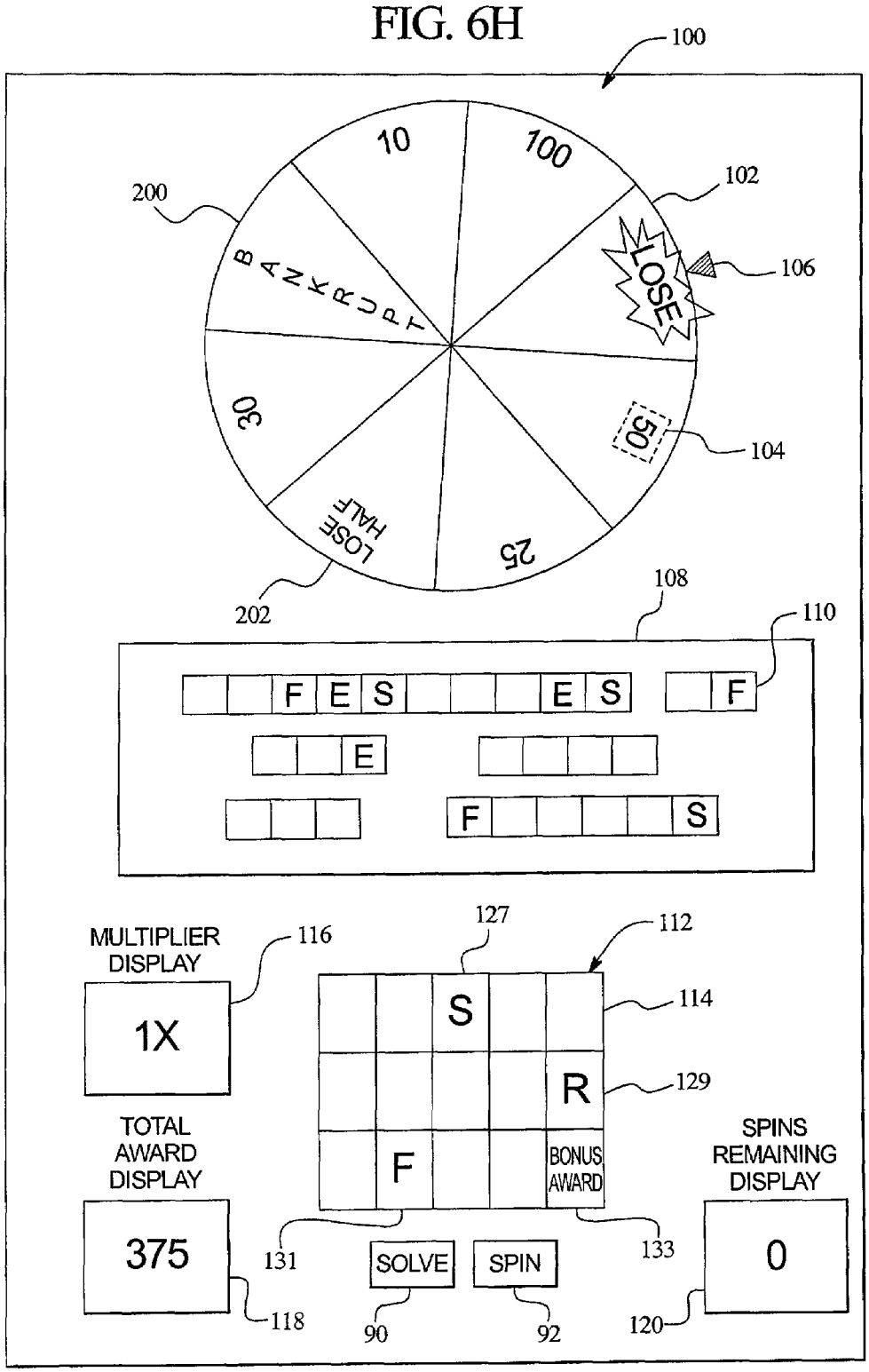

Referring to FIG. 6H, the player spins the wheel 100 and the indicator 106 indicates a section including the "LOSE" symbol 204. The "LOSE" symbol, eliminates one of the letters obtained by the player in one of the previous spins. In this example, the lose symbol eliminates the letter "R" from the phrase displayed in the sequence 108 as well as the associated award obtained by the player for picking the letter "R." In FIG. 6D, the player obtained the letter "R" by picking selection 129 in the selection display 112. In that spin, the player obtained an activation award of fifty. Therefore in FIG. 6H, the letter "R" is removed from the phrase indicated in sequence 108 and an award value of fifty is subtracted from the player's total award as indicated in total award display 118. Therefore, the player's new total award is three hundred seventy-five as indicated in total award display 118. The player does not have any spins remaining in the game as indicated by the spins remaining display 120. At this point, the player has one opportunity to determine the phrase indicated in symbol display 108. If the player determines the phrase, the player obtains an additional award or awards associated with determining the phrase. In one embodiment, an input such as a keyboard enables the player to input the letters for each blank space shown in the sequence 108. If the player determines the phrase correctly, the player obtains the additional award or awards in the game. If the player does not determine the phrase correctly or cannot figure out the phrase, the player does not obtain any additional awards in the game and the game ends.

Figure 6I:
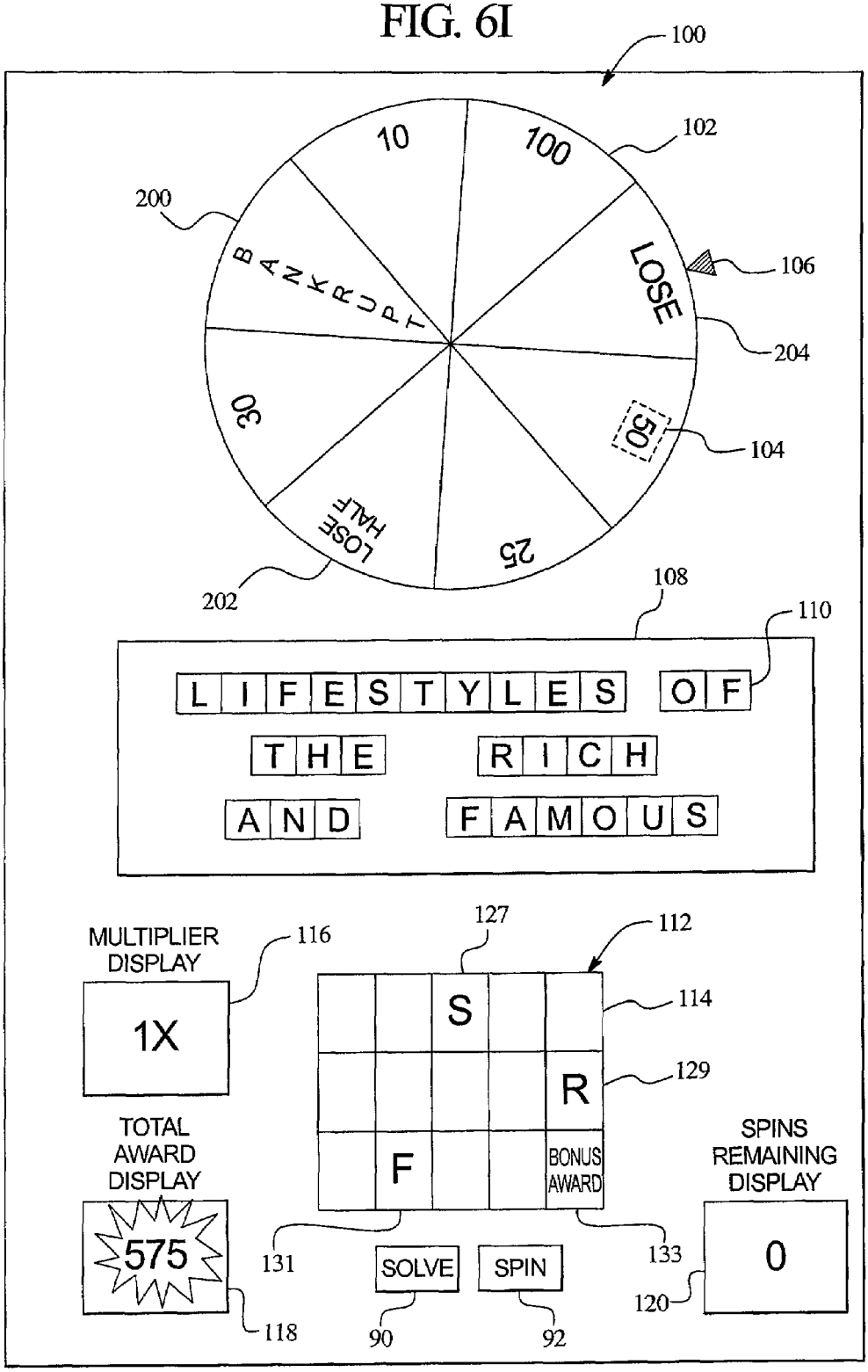

Referring to FIG. 6I, the player successfully determines or solves the phrase indicated in sequence 108, which is "Lifestyles of the Rich and Famous." Since the player successfully solved the phrase displayed in sequence 108, the player obtains an additional award of two hundred. It should be appreciated that the additional award for solving the phrase in sequence 108 may be any award desired by the game implementer including, but not limited to, free spins, free games, values, credits or any other desired award. The additional award of two hundred is added to the player's previous total award of three hundred seventy-five to give the player a new total award of five hundred seventy-five as indicated by the total award display 118. The game ends and the player is provided with the total award of five hundred seventy-five.

Figure 7:
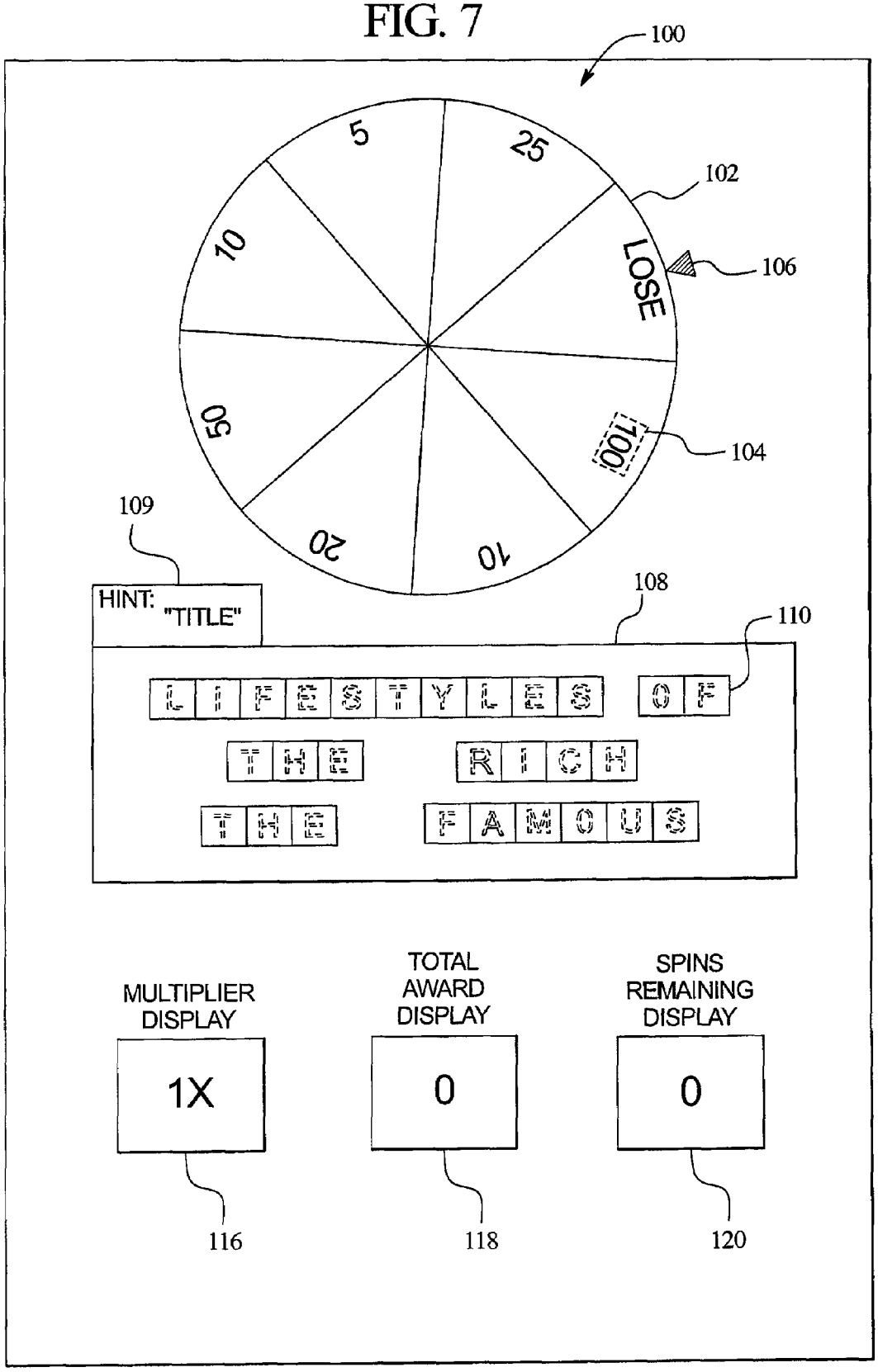
FIG. 7 is an enlarged front elevation view of one of the display devices of FIGS. 1A and 1B illustrating a further embodiment of the present invention.

In FIG. 7, another embodiment of the present invention is illustrated where the player picks elements or symbols 110 in symbol display 108 by touching or pressing the individual symbols 110 in the symbol display 108. The player can only touch or press one symbol 110 at a time. All other symbols that are identical to the symbol that is revealed by the picked selection are revealed accordingly. Initially, the symbols are hidden or masked from the player at the start of the game. After the player selects a particular link or selection in sequence 108, the associated letter is revealed to the player. In one embodiment, a relationship display or hint display 109 indicates the type of word or phrase that is indicated in symbol display 108. The relationship display 109 in this example indicates that the phrase in symbol display 108 is a title. It should be appreciated that the phrase or words may be any type of word or phrase desired by the game implementer. In this example, therefore, the player knows that they are trying to determine a title displayed in sequence 108. The player obtains a number of spins at the beginning of a game and uses the spins to spin the wheel 100 to indicate symbols on the wheel. The multiplier indicated in multiplier display 116 increases by one for each letter revealed by the player. The total award display displays the total accumulated award obtained by the player in a game as indicated by the total award display 118. The spins remaining display 120 indicates the total number of spins that the player has remaining in the game.

Figure 8A:
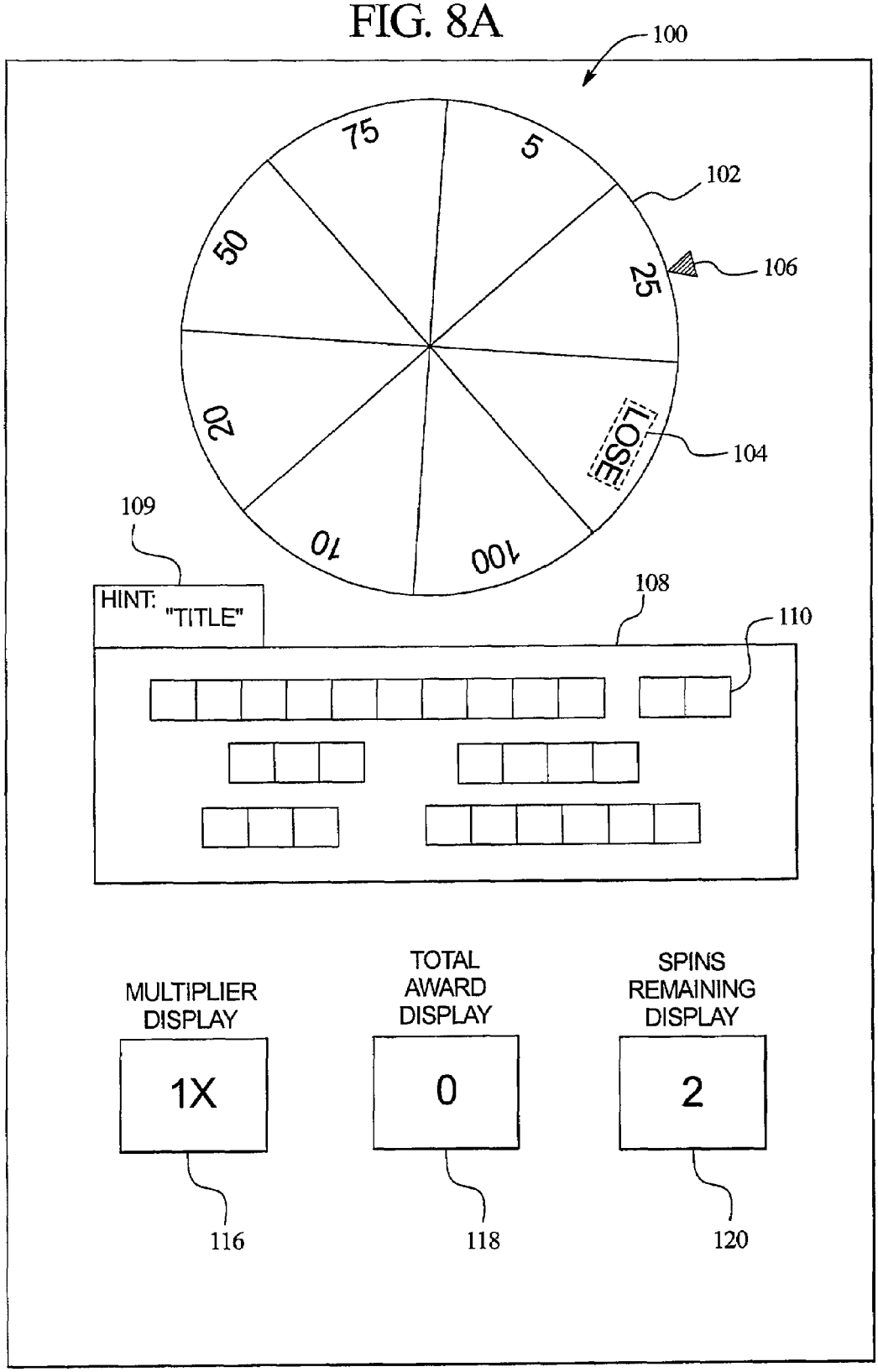
FIGS. 8A, 8B and 8C are enlarged front elevation views of one of the display devices of FIGS. 1A and 1B illustrating an example of the embodiment of FIG. 7 where the player is provided with two spins to begin the game.

Referring to FIG. 8A, an example of the embodiment of FIG. 7 is illustrated where the player is provided with two spins in the game. A player begins a game with a total award of zero as indicated by the total award display 118. Also, the player begins with a multiplier of "1×" as indicated by the multiplier display 116. The multiplier is reset to "1×" after each activation by the player. Additionally, the processor randomly determines a phrase or word to display to the player in sequence 108. The associated hint is displayed in the relationship display 109. In this example, the phrase is a title. The title may be a book title, movie title, or any other title as desired.

Figure 8B:
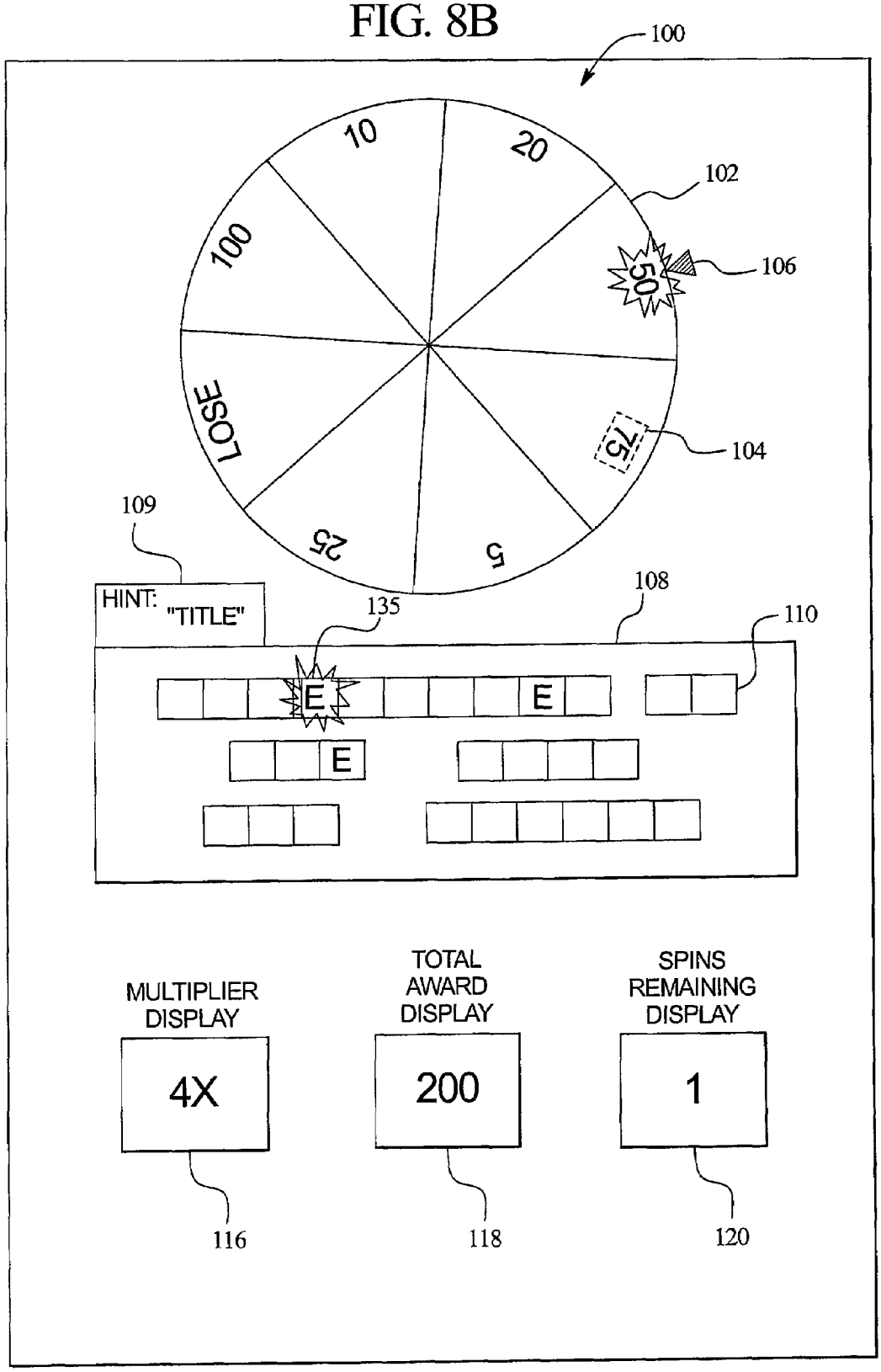

In FIG. 8B, the player uses their first spin to spin the wheel 100 in the game. After the wheel stops spinning, the indicator 106 indicates an award of fifty. The player picks selection 135 in the phrase in sequence 108. Section 135 reveals the letter "E", which also occurs three times in the phrase displayed in sequence 108. Therefore, the player obtains a "4×" multiplier as indicated by multiplier display 116. The indicated award of fifty is multiplied by the "4×" multiplier to provide the player with an activation award of two hundred for that spin. The activation award of two hundred is added to the player's total award of zero to give the player a new total award of two hundred for the game. The player has only one spin remaining in the game as indicated by spins remaining display 120.

Figure 8C:
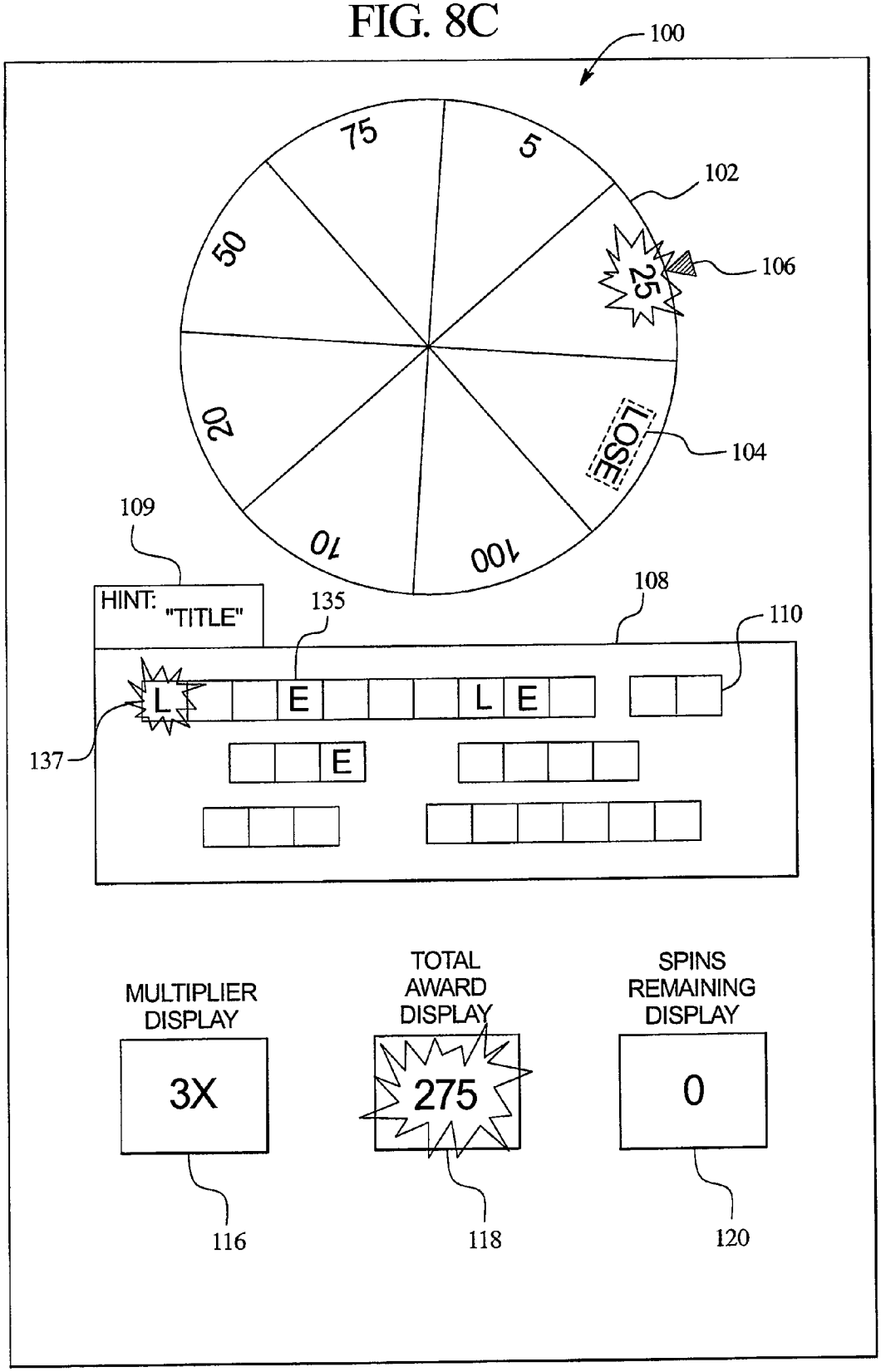

Referring to FIG. 8C, the player spins the wheel 100 again in the game. The indicator 106 indicates an award of twenty-five after the wheel stops spinning. The player then picks selection 137 in sequence 108. Selection 137 reveals the letter "L" which occurs one other time in the sequence 108. The player obtains a "3×" multiplier as indicated by multiplier display 116 because the player obtained two letters in that spin. The award of twenty-five is multiplied by the "3×" multiplier which gives the player an activation award of seventy-five for that spin. The activation award of seventy-five is added to the player's previous total award of two hundred to give the player a new total award of two hundred seventy-five for the game as indicated by total award display 118. The game ends because the player does not have any spins remaining as indicated by spins remaining display 120. The gaming device provides the player with the total award of two hundred seventy-five. In one embodiment, the player may now attempt to solve or determine the phrase displayed in sequence 108. If the player cannot determine or solve the phrase displayed in sequence 108, the player obtains the total award indicated in total award display 118 and the game ends. If the player determines the phrase indicated in sequence 108, the player obtains an additional award as described above. In this example, the player was not able to determine the phrase indicated in sequence 108. Thus, the player obtains the total award of two hundred seventy-five as indicated in total award display 118 and the game ends.

Figure 9:
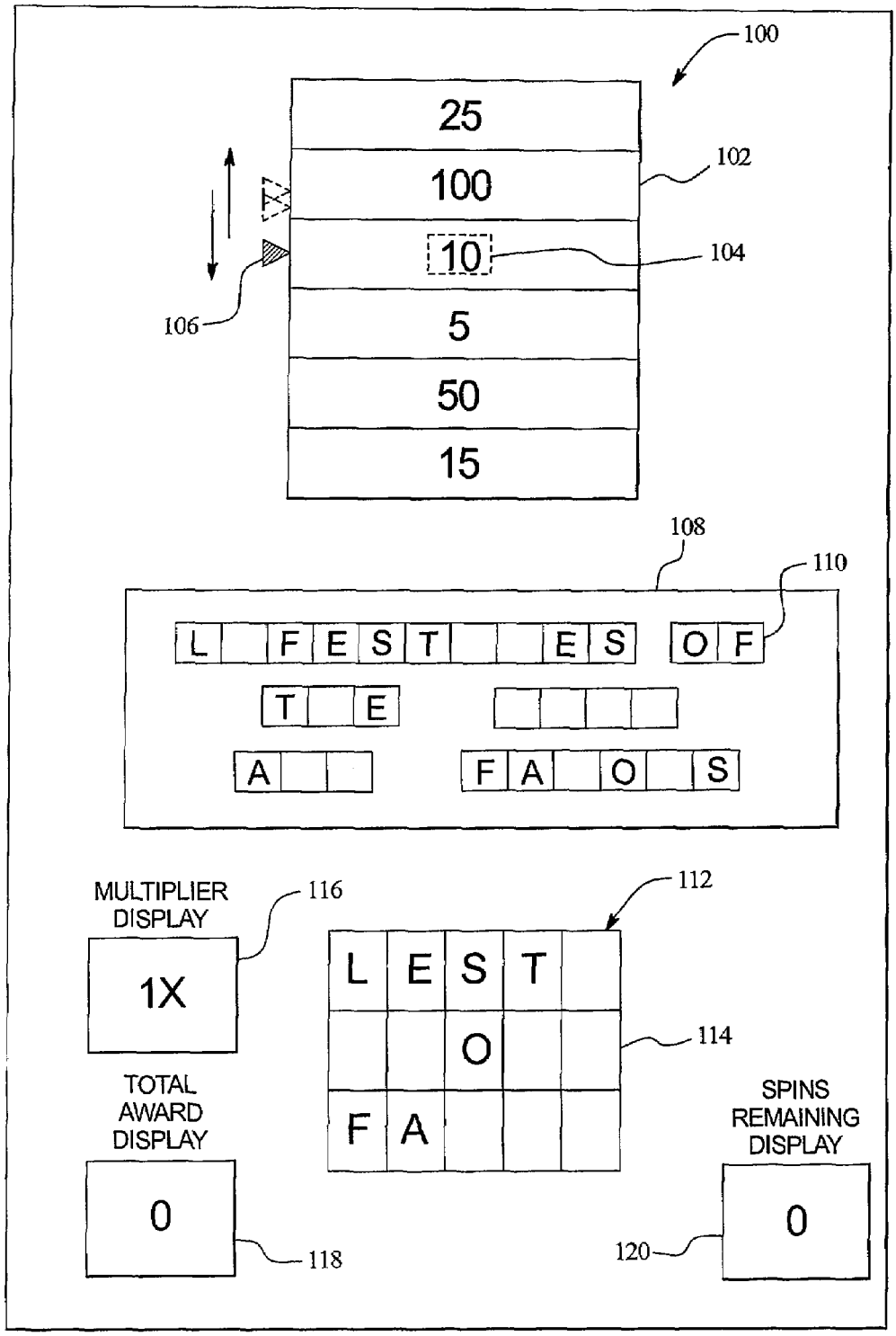
FIG. 9 is an enlarged front elevation view of the one of the display devices of FIGS. 1A and 1B illustrating another embodiment of the present invention where the indicator indicates one of the sections in a plurality of sections arranged in a column.

Referring to FIG. 9, another embodiment of the present invention is illustrated where the award distributor includes a plurality of sections 102 displayed in a column 100. Each section has an associated awards symbol 104. The indicator 106 moves upward and downward along the perimeter of the column 100. The indicator indicates one of the sections 102 in the column 100. This embodiment illustrates another method in which the award symbol or risk symbols may be indicated in the present invention. The rest of the game proceeds in a manner as described above.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming system comprising:

at least one input device;

at least one display device;

at least one processor; and at least one memory device storing a plurality of instructions, which when executed by the at least one processor, cause the at least one processor to operate with the at least one input device and the at least one display device to:

(i) display a sequence including a plurality of groups, a plurality of said groups including a plurality of related elements;

(ii) cause an award distributor including a plurality of award symbols to activate and indicate one of the award symbols;

(iii) display a plurality of masked selections, wherein each of the groups is associated with at least one of the masked selections;

(iv) enable a player to pick one of the masked selections;

(v) reveal the related elements in the group associated with the picked masked selection;

(vi) determine a modifier based on the number of related elements in the group associated with the picked masked selection;

(vii) determine an activation award based on an award associated with the indicated award symbol and the modifier; and (viii) display the activation award.

2. The gaming system of claim 1, wherein the award distributor includes a wheel having a plurality of sections and a section indicator, and wherein the plurality of award symbols are displayed by the sections of the wheel.

3. The gaming system of claim 1, wherein the sequence is a word and the elements of each group represent one of the letters in the word.

4. The gaming system of claim 1, wherein the sequence is a plurality of words and the elements of each group represent one of the letters in the plurality of words, wherein the elements of each group are all the same letter in said plurality of words.

5. The gaming system of claim 1, wherein the plurality of instructions, when executed by the at least one processor, cause the at least one processor to operate with the at least one input device and the at least one display device to enable the player to pick one of the selections using a touch screen.

6. The gaming system of claim 1, wherein the plurality of instructions, when executed by the at least one processor, cause the at least one processor to operate with the at least one input device and the at least one display device to cause the award distributor to indicate an award symbol a plurality of times and determine an activation award each time an award symbol is indicated.

7. The gaming system of claim 6, wherein the number of times the award distributor indicates an award symbol is predetermined.

8. The gaming system of claim 6, wherein the number of times the award distributor indicates an award symbol is randomly determined.

9. The gaming system of claim 6, wherein the plurality of instructions, when executed by the at least one processor, cause the at least one processor to operate with the at least one input device and the at least one display device to display a plurality of activation selections, wherein a different number of activations is associated with each of said activation selections, and enable the player to pick one of the activation selections to receive a number of activations of the award distributor.

10. The gaming system of claim 1, wherein the plurality of instructions, when executed by the at least one processor, cause the at least one processor to operate with the at least one input device and the at least one display device to increase the modifier by a predetermined amount for at least one of the related elements revealed in the group associated with the picked selection.

11. The gaming system of claim 1, wherein the plurality of instructions, when executed by the at least one processor, cause the at least one processor to operate with the at least one input device and the at least one display device to increase the modifier by a randomly determined amount for at least one of the related elements revealed in the group associated with the picked selection.

12. The gaming system of claim 1, wherein the masked selections include at least one terminator symbol.

13. The gaming system of claim 1, wherein the award distributor includes at least one terminator symbol.

14. The gaming system of claim 1, wherein the elements in each group are identical.

15. The gaming system of claim 1, wherein the plurality of instructions, when executed by the at least one processor, cause the at least one processor to operate with the at least one input device and the at least one display device to display an additional award if all of the elements in the groups in the sequence are revealed.

16. The gaming system of claim 1, wherein at least one of the award symbols and the masked selections include risk symbols.

17. The gaming system of claim 16, wherein upon indication of a risk symbol, the plurality of instructions, when executed by the at least one processor, cause the at least one processor to operate with the at least one input device and the at least one display device to decrease at least one of: the groups in the sequence, the components in the groups, the award associated with one of the groups picked by the player, the total award and the number of masked selections.

18. The gaming system of claim 1, wherein the plurality of instructions, when executed by the at least one processor, cause the at least one processor to operate with the at least one input device and the at least one display device to display a bonus modifier for at least one of the related elements in group associated with the picked masked selection.

19. The gaming system of claim 18, wherein the bonus modifier is selected from the group consisting of: a positive value, a negative value and a multiplier.

20. A gaming system comprising:

at least one input device;

at least one display device;

at least one processor; and at least one memory device storing a plurality of instructions, which when executed by the at least one processor, cause the at least one processor to operate with the at least one input device and the at least one display device to:

(i) display an independent sequence including a plurality of groups,the groups including at least one group with a plurality of letters associated with the sequence;

(ii) cause an award distributor including a plurality of award symbols to activate and indicate one of the award symbols;

(iii) display a plurality of selections, wherein each of the groups is associated with at least one of the masked selections;

(iv) enable a player to pick one of the selections;

(v) reveal the letters in the group associated with the picked masked selection;

(vi) independently determine a modifier based on the number of revealed letters from said group associated with the picked masked selection in said sequence;

(vii) determine an activation award based on an award associated with the indicated award symbol and the modifier; and (viii) display the activation award.

21. The gaming system of claim 20, wherein the award distributor includes a wheel having a plurality of sections and a section indicator and wherein the plurality of award symbols are displayed by the sections of the wheel.

22. The gaming system of claim 20, wherein the sequence forms a plurality of words.

23. The gaming system of claim 20, wherein the plurality of instructions, when executed by the at least one processor, cause the at least one processor to operate with the at least one input device and the at least one display device to increase the modifier by a predetermined amount for at least one letter revealed in a group picked by the player.

24. The gaming system of claim 20, wherein the plurality of instructions, when executed by the at least one processor, cause the at least one processor to operate with the at least one input device and the at least one display device to determine and display an additional award if all of the letters in the groups in the sequence are revealed.

25. A gaming system comprising:

at least one input device;

at least one display device;

at least one processor; and at least one memory device storing a plurality of instructions, which when executed by the at least one processor, cause the at least one processor to operate with the at least one input device and the at least one display device to:

(i) display an independent sequence including a plurality of groups, each of said groups including at least one element and at least one of said groups including a plurality of related elements;

(ii) cause an award distributor including a plurality of award symbols to indicate one of the award symbols for a number of activations;

(iii) display a plurality of masked selections, wherein the groups is associated with at least one of the masked selections; and (iv) for each activation of the award distributor:

(a) enable a player to pick one of the selections;

(b) reveal the related elements in the group associated with the picked masked selection;

(c) determine a modifier based on the number of related elements in the group associated with the picked masked selection;

(d) determine an activation award based on an award associated with the indicated award symbol and the modifier; and (e) display the activation award.

26. The gaming system of claim 25, wherein the number of activations is predetermined.

27. The gaming system of claim 25, wherein the number of activations is randomly determined.

28. The gaming system of claim 25, wherein at least one of the award symbols and the masked selections include risk symbols.

29. The gaming system of claim 28, wherein the plurality of instructions, upon indication of a risk symbol, cause the at least one processor to operate with the at least one input device and the at least one display device to decrease at least one of: the groups in the sequence, the elements in the groups, the activation award, the number of masked selections and the number of activations.

30. The gaming system of claim 25, wherein the plurality of instructions, when executed by the at least one processor, cause the at least one processor to operate with the at least one input device and the at least one display device to reset the modifier after each of the activations.

31. The gaming system of claim 25, wherein the plurality of instructions, when executed by the at least one processor, cause the at least one processor to operate with the at least one input device and the at least one display device to reset the modifier after a plurality of the activations.

32. A method of operating a gaming device, the method comprising:

(a) activating an award distributor including a plurality of award symbols;

(b) causing the award distributor to indicate one of a plurality of award symbols;

(c) displaying a sequence including a plurality of groups, a plurality of the groups including a plurality of related elements;

(d) enabling a player to pick one of a plurality of masked selections, wherein each of the groups is associated with at least one of the masked selections;

(e) revealing the related elements in the group associated with the picked masked selection;

(f) determining a modifier based on the number of related elements in the group associated with the picked masked selected;

(g) determining an activation award based on an award associated with the indicated award symbol and the modifier; and (h) displaying the activation award.

33. The method of claim 32, which is provided through a data network.

34. The method of claim 33, wherein the data network is an internet.

35. A method of operating a gaming device, the method comprising:

(a) activating an award distributor including a plurality of award symbols;

(b) causing the award distributor to activate and indicate one of the plurality of award symbols;

(c) displaying an independent sequence including a plurality of groups, the groups including at least one group with a plurality of letters associated with the sequence;

(d) enabling a player to pick one of the masked selections, wherein each of the groups is associated with at least one the masked selections;

(e) revealing the letters in the group associated with the picked masked selection;

(f) determining a modifier based on the number of revealed letters from said group associated with the picked masked selected in said sequence;

(g) determining an activation award based on an award associated with the indicated award symbol and the modifier; and (h) displaying the activation award.

36. The method of claim 35, which is provided through a data network.

37. The method of claim 36, wherein the data network is an internet.

* * * * *

UNITED STATES PATENT AND TRADEMARK OFFICE

CERTIFICATE OF CORRECTION

PATENT NO. : 7,488,247 B2
APPLICATION NO. : 11/952704
DATED : February 10, 2009
INVENTOR(S) : Andrea C. Hughs-Baird et al.

It is certified that error appears in the above-identified patent and that said Letters Patent is hereby corrected as shown below:

In Claim 20, Column 23, Line 63, change “groups,the” to --group, the--.

Signed and Sealed this

Twenty-sixth Day of May, 2009

JOHN DOLL
*Acting Director of the United States Patent and Trademark Office*